US007164405B1

(12) United States Patent
Jeong et al.

(10) Patent No.: US 7,164,405 B1
(45) Date of Patent: Jan. 16, 2007

(54) METHOD OF DRIVING LIQUID CRYSTAL PANEL AND APPARATUS

(75) Inventors: Yun Cheol Jeong, Seoul (KR); Chang Yeon Kim, Kyunggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/327,282

(22) Filed: Jun. 4, 1999

(30) Foreign Application Priority Data

Jun. 27, 1998 (KR) ..... 1998-24626
Sep. 3, 1998 (KR) ..... 1998-36335
May 7, 1999 (KR) ..... 1999-16409

(51) Int. Cl.
*G09G 3/36* (2006.01)

(52) U.S. Cl. ..... 345/94

(58) Field of Classification Search ..... 345/92, 345/94, 208, 210, 98, 99, 100, 87
See application file for complete search history.

(56) References Cited

U.S. PATENT DOCUMENTS 3,883,778 A * 5/1975 Kaji et al. ..... 315/205
4,021,607 A * 5/1977 Amano ..... 348/800
4,193,095 A * 3/1980 Mizushima ..... 348/800
4,427,979 A * 1/1984 Clerc et al. ..... 345/94
4,649,383 A 3/1987 Takeda et al. ..... 345/87
4,750,813 A * 6/1988 Ohwada et al. ..... 345/87
4,845,482 A * 7/1989 Howard et al. ..... 345/58
4,922,240 A * 5/1990 Duwaer ..... 345/100
5,311,169 A * 5/1994 Inada et al. ..... 345/77
5,442,370 A * 8/1995 Yamazaki et al. ..... 345/94
5,568,163 A * 10/1996 Okumura ..... 345/100
5,606,342 A * 2/1997 Shoji et al. ..... 345/94
5,781,168 A * 7/1998 Osada et al. ..... 345/76
5,870,070 A * 2/1999 Furukawa et al. ..... 345/99
6,064,459 A * 5/2000 Lee ..... 349/139
6,072,453 A * 6/2000 Okamoto et al. ..... 345/97
6,175,351 B1 * 1/2001 Matsuura et al. ..... 345/98
6,201,590 B1 * 3/2001 Ohta et al. ..... 349/141

(Continued)

FOREIGN PATENT DOCUMENTS

EP 487742 A1 6/1992

(Continued)

OTHER PUBLICATIONS

Search Report dated Nov. 17, 1999.

(Continued)

*Primary Examiner*—Richard Hjerpe
*Assistant Examiner*—Kevin M. Nguyen
(74) *Attorney, Agent, or Firm*—McKenna Long & Aldridge LLP

(57) ABSTRACT

A method and apparatus of driving a liquid crystal panel to prevent an image distortion and a non-uniform phenomenon in the light transmissivity caused by propagation delay in a scanning wiring of the liquid crystal panel. Data signal voltages are supplied to a signal wiring with a predetermined time interval in accordance with a delay characteristic of a scanning signal in the scanning wiring. Accordingly, even when the scanning signal is delayed in the scanning wiring, the data signal voltages are accurately applied to all liquid crystal cells and hence a picture displayed on the liquid crystal panel is not distorted.

27 Claims, 30 Drawing Sheets

U.S. PATENT DOCUMENTS

| | | | | |
|---|---|---|---|---|
| 6,232,944 | B1 * | 5/2001 | Kumagawa et al. | 345/98 |
| 6,326,941 | B1 * | 12/2001 | Yamazaki et al. | 345/95 |
| 6,504,522 | B1 * | 1/2003 | Shiraki et al. | 345/98 |

FOREIGN PATENT DOCUMENTS

| | | | |
|---|---|---|---|
| EP | 0554129 | | 8/1993 |
| EP | 554129 | A1 | 8/1993 |
| EP | 644523 | | 3/1995 |
| GB | 2334610 | | 8/1999 |
| JP | 64-051989 | | 2/1989 |
| JP | 62-147223 | | 3/1989 |
| JP | 4-120591 | | 4/1992 |
| JP | 5-313135 | | 11/1993 |
| JP | 07-318898 | | 12/1995 |
| JP | 8262994 | | 10/1996 |
| JP | 10-293564 | | 11/1998 |
| JP | 11-38937 | | 2/1999 |
| JP | 11038937 | | 6/1999 |

OTHER PUBLICATIONS

Japanese Search Report dated Jul. 18, 2000.

* cited by examiner

METHOD OF DRIVING LIQUID CRYSTAL PANEL AND APPARATUS

BACKGROUND OF THE INVENTION

1. Field of the Invention

This invention relates to a matrix type liquid crystal display device, and more particularly to a method of driving a liquid crystal panel including thin film transistors and an apparatus thereof.

2. Description of the Prior Art

Generally, in a matrix type liquid crystal display device with thin film transistors, the thin film transistors are provided in the liquid crystal display panel. This matrix type liquid crystal display device can produce a high contrast display even when driven at a low duty ratio or duty cycle in a multiple-line multiplex driving mode. As shown in FIG. 1, the matrix type liquid crystal display device consists of a liquid crystal panel 10 having a plurality of thin film transistors and a plurality of liquid crystal cells, and a scanning side driving circuit 12 and a signal side driving circuit 14 which are connected to the liquid crystal panel 10. The scanning side driving circuit 12 supplies a scanning voltage to a scanning wiring 11 in the liquid crystal panel 10. This scanning wiring 11 consists of scanning electrodes to which the gate electrodes of the thin film transistors are connected. Further, the scanning wiring 11 intersects with signal wiring 13 consisting of signal electrodes. Each of these signal electrodes is connected to the drain electrodes of the thin film transistors. Meanwhile, the signal side driving circuit 14 transforms display data input through a display data input line 15 into a signal voltage to be supplied to the liquid crystal cells and then supplies the signal voltage to the signal wiring 13. The turn-on and turn-off operations of the thin film transistor are controlled by the scanning voltage. When the thin film transistor is turned on, each the liquid crystal cell charges a signal voltage input via the drain and source electrodes of the thin film transistor from the signal wiring 13. Further, each the liquid crystal cell maintains the charged voltage during a period when the thin film transistor is turned off.

FIG. 2 shows the scanning wiring 11 in the liquid crystal panel corresponding to one line. The gate electrode of the thin film transistor 16 for each of the liquid crystal cells is connected to the scanning wiring 11, and the drain electrode of the thin film transistor 16 is connected to the signal wiring 13 which intersects with the scanning wiring 11. If the scanning wiring 11 corresponding to one line is represented by an electric equivalent circuit, it can be expressed by resistors 18 and capacitors 20 as shown in FIG. 3. Resistors 18 constitute the resistance of the scanning wiring 11 and their value is determined by the material constituting the wiring and the shape of the wiring, such as the width, the length, the thickness, etc. Capacitors 20 has a value obtained by adding the capacitance of the gate electrode of the thin film transistors, the capacitance between electrodes included in the liquid crystal cells, the capacitance between the signal wiring 13 and the scanning wiring 11, and the stray capacitance around the scanning wiring 11, etc. If a scanning voltage, which is a rectangular wave, whose rising time $t_r$ and falling time $t_f$ are short, is applied to the scanning voltage input terminal, the resistors 18 and the capacitors 20 elongate the rising time $t_r$ and the falling time $t_f$ of the scanning voltage arriving at the gate electrode of the thin film transistor 16, which is physically distant from the scanning voltage input terminal (i.e., which is positioned at the right end of FIG. 3). In order words, the scanning voltage is delayed proportionally to the propagation distance between the scanning voltage input terminal and the specific stage of the scanning wiring 11. This results in distortion of the voltage at the right stage of the scanning wiring 11 that is far away from the scanning voltage input terminal.

FIG. 4 illustrates distortion when a waveform of the scanning voltage GS is propagated through the scanning wiring. The scanning voltage GS is applied to the scanning voltage input terminal during a period when the signal voltage DS is supplied. At this time, a delayed scanning voltage DGS slowly increasing from the rising edge of the scanning voltage GS appears in the right hand stage of the scanning wiring 11. The thin film transistor positioned in the right hand stage of the scanning wiring 11, which is driven by the delayed gate voltage DGS, turns on when the delayed gate voltage DGS becomes higher than its threshold voltage $V_{th}$. In other words, the delayed gate voltage DGS is equivalent to the effective gate voltage EGS delayed by $\tau_1$, which corresponds to the product of the resistance of the resistors 18 and the capacitance of the capacitors 20 shown in FIG. 3. The delayed scanning voltage DGS decreases slowly from the falling edge of the scanning voltage GS. The thin film transistor 16 positioned in the right hand stage of the scanning wiring 11 is turned off when the delayed gate voltage DGS becomes lower than its threshold voltage $V_{th}$. As a result, an effective gate voltage EGS delayed by a time corresponding to the time constant $\tau_1$ is applied to the gate electrode of the thin film transistor 16. With the effective scanning voltage EGS, the liquid crystal cell positioned at the right hand stage of the scanning wiring 11 charges the signal voltage DS, during the period extending from the time point after the rising edge of the signal voltage DS by the time constant $\tau_1$ of the scanning wiring 11 until the time from the falling edge of the signal voltage DS by a time corresponding to the time constant $\tau_1$ of the scanning wiring 11. In other words, the liquid crystal cell charges a signal voltage of the next line during an interval of the time constant from the falling edge of the scanning voltage GS. Accordingly, the effective charge voltage ECDS charged into the liquid crystal cell may fail to maintain the signal voltage DS and changes by a different voltage $\Delta V_{PIXEL}$ between it and a signal voltage to be applied to the next line liquid crystal cell.

FIG. 5 and FIG. 6 are graphs illustrating a voltage change appearing at gate electrodes of thin film transistors 16 when the scanning voltage GS is applied to the scanning wiring 11 of the liquid crystal panel 10. FIG. 5 represents a voltage change on each of the gate electrodes of the thin film transistors 16 during the rising edge of the scanning voltage GS. FIG. 6 represents a voltage change on each of the gate electrodes of the thin film transistors 16 during the falling edge of the scanning voltage GS. As shown in FIGS. 5 and 6, voltages on the gate electrodes of the thin film transistors 16 connected to the scanning wiring 11 are slowly changed. It can be seen from this that a propagation delay amount of the scanning voltage GS in the scanning wiring 11 is large. Due to this propagation delay, a signal voltage DS charged into the liquid crystal cells is distorted. This result in an image displayed on the liquid crystal panel 10 being distorted as well as a light transmissivity in the right side and the left side of the liquid crystal panel 10 being made different. The extent of these disadvantages increases as the length of the scanning wiring 11 is made larger.

One technique for overcoming the above-discussed disadvantages is disclosed in the U.S. Pat. No. 4,649,383, by Makoto Takeda, et al. on Mar. 10, 1987. This pre-scanning method advances time points of the turning-on and turningoff of the thin film transistors connected to the scanning wiring by supplying a pre-scanning voltage PGS one time before the signal voltage DS applied to the signal wiring, as shown in FIG. 7. Accordingly, the voltage charged into the liquid crystal cell is not influenced by the signal voltage DS supplied for liquid crystal cell on the next line. As a result, the free-scanning method could prevent a distortion of an image displayed on the liquid crystal panel, and also causes uniform light transmissivity in the liquid crystal panel.

In the pre-scanning method, however, because the rising edge and the falling edge of the scanning voltage PGS supplied to the scanning voltage input terminal is advanced compared with those of the signal voltage DS, a charging time SWGS of the signal voltage of the liquid crystal cell positioned in the scanning wiring close to the scanning voltage input terminal is reduced, as shown in FIG. 7. Also, a charge characteristic of the liquid crystal cells close to the scanning voltage input terminal becomes different from that of the liquid crystal cells far away from the scanning voltage input terminal. This results in the distortion image displayed on the liquid crystal panel being as well as a non-uniform light transmissivity in the liquid crystal panel.

SUMMARY OF THE INVENTION

Accordingly, it is an object of the present invention to provide a method of driving a liquid crystal panel which can prevent a distortion of an image as well as a non-uniform phenomenon in the light transmissivity due to the propagation delay in the scanning wiring, and an apparatus thereof.

Another object of the present invention is to provide a liquid crystal panel drive method and apparatus capable of securing an uniformity in the charging time of liquid crystal cells on a liquid crystal panel.

In order to obtain the object of the invention, a method of driving a liquid crystal panel according to one aspect of the present invention, as broadly defined and embodied herein, includes steps of: applying a scanning signal voltage to the scanning wire; and supplying data signal voltages to the signal wire with a time corresponding to a predetermined interval.

A method of driving a liquid crystal panel according to another aspect of the present invention, as embodied herein, includes steps of: applying a scanning signal voltage to the scanning wire; supplying data signal voltages to the signal wire; and delaying the data signal voltage supplied to the signal wire intersecting with the end of the scanning wire.

A method of driving a liquid crystal panel according to still another aspect of the present invention, as embodied herein, includes steps of: applying a scanning signal voltage to the scanning wire; and supplying data signal voltages having a width enlarged in accordance with a position at the scanning wire to the signal wire.

A method of driving a liquid crystal panel according to still another aspect of the present invention, as embodied herein, includes steps of: applying a scanning signal voltage to the scanning wire; supplying data signal voltages to the signal wire; and allowing the data signal voltages to be supplied to the signal wire to have a different width in accordance with a position at the scanning wire.

A method of driving a liquid crystal panel according to still another aspect of the present invention, as embodied herein, includes steps of: applying scanning signal voltages each having a width reduced in accordance with a position at the signal wire to the scanning wire; and supplying data signal voltages to the signal wire.

A method of driving a liquid crystal panel according to still another aspect of the present invention, as embodied herein, includes steps of: applying scanning signal voltages each having a width reduced in accordance with a position at the signal wire to the scanning wire; and supplying data signal voltages each having a width enlarged in accordance with a position at the scanning wire to the signal wire.

Further, a driving apparatus for a liquid crystal panel according to yet another aspect of the present invention, as embodied herein, includes: scanning side driving means for applying a scanning signal voltage to the scanning wire; and signal side driving means for supplying data signal voltages to the signal wire with a time corresponding to a predetermined interval.

A driving apparatus for a liquid crystal panel according to still another aspect of the present invention, as embodied herein, includes: scanning side driving means for applying a scanning signal voltage to the scanning wire; signal side driving means for supplying data signal voltages to the signal wire; and timing control means for delaying a data signal voltage supplied to the signal wire intersecting with the end of the scanning wire.

A driving apparatus for a liquid crystal panel according to still another aspect of the present invention, as embodied herein, includes: scanning side driving means for applying a scanning signal voltage to the scanning wire; and signal side driving means for supplying a data signal voltage having a width enlarged in accordance with a position at the scanning wire to the signal wire.

A driving apparatus for a liquid crystal panel according to still another aspect of the present invention, as embodied herein, includes: scanning side driving means for applying a scanning signal voltage to the scanning wire; signal side driving means for supplying data signal voltages to the signal wire; and width control means for making the data signal voltages to be supplied to the signal wire have a different width in accordance with a position at the scanning wire.

A driving apparatus for a liquid crystal panel according to still another aspect of the present invention, as embodied herein, includes: scanning side driving means for applying scanning signal voltages to the scanning wire; signal side driving means for supplying data signal voltages to the signal wire; and width control means for making the scanning signal voltages to be supplied to the scanning wire have a different width in accordance with a position at the signal wire.

A driving apparatus for a liquid crystal panel according to still another aspect of the present invention, as embodied herein, includes: scanning side driving means for applying scanning signal voltages having a width reduced in accordance with a position of the signal wire to the scanning wire; and signal side driving means for supplying data signal voltages having a width enlarged in accordance with a position of the scanning wire to the signal wire.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
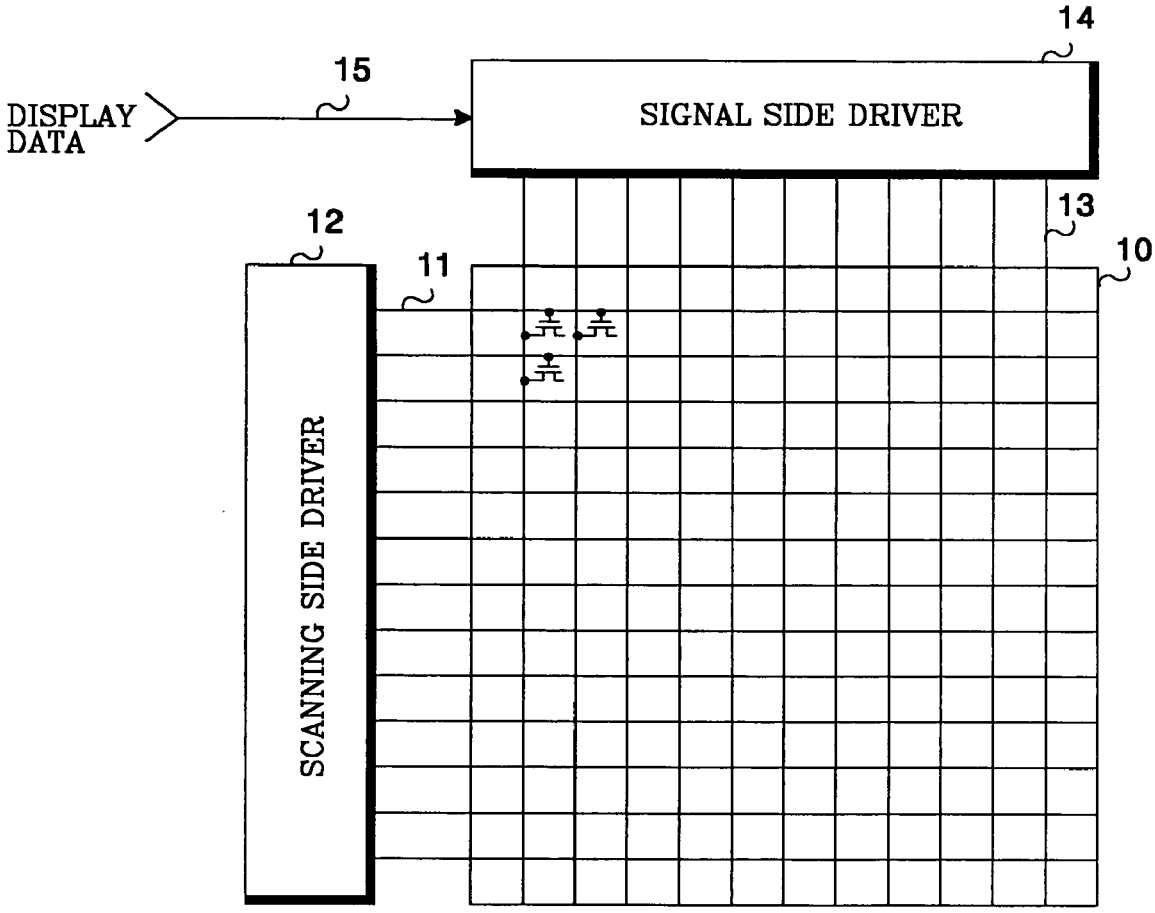
FIG.1 PRIOR ART
FIG. 1 is a block diagram showing a configuration of a conventional liquid crystal panel driving apparatus.
Figure 2:
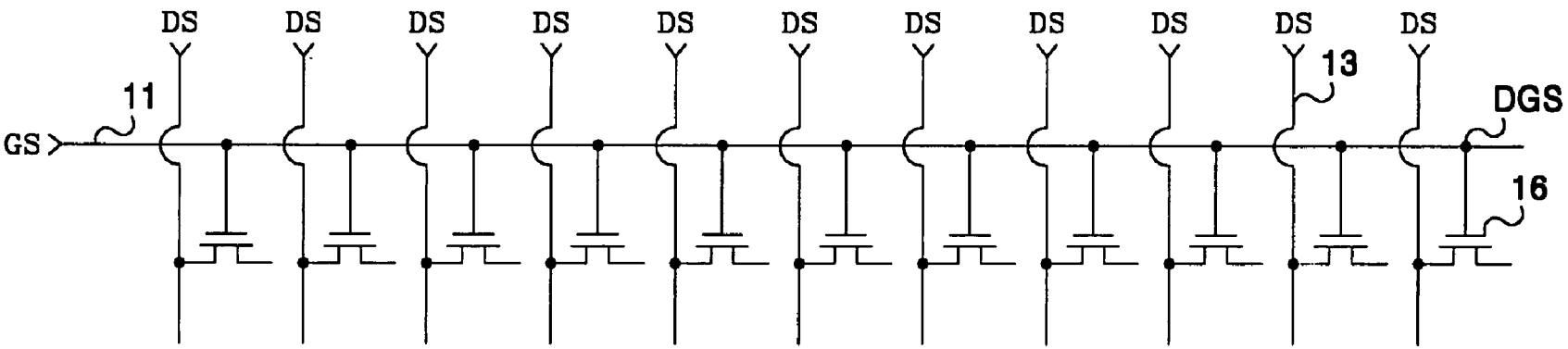
FIG.2 PRIOR ART
FIG. 2 is a view for explaining a circuit configuration of a scanning wiring for one line shown in FIG. 1.
Figure 3:
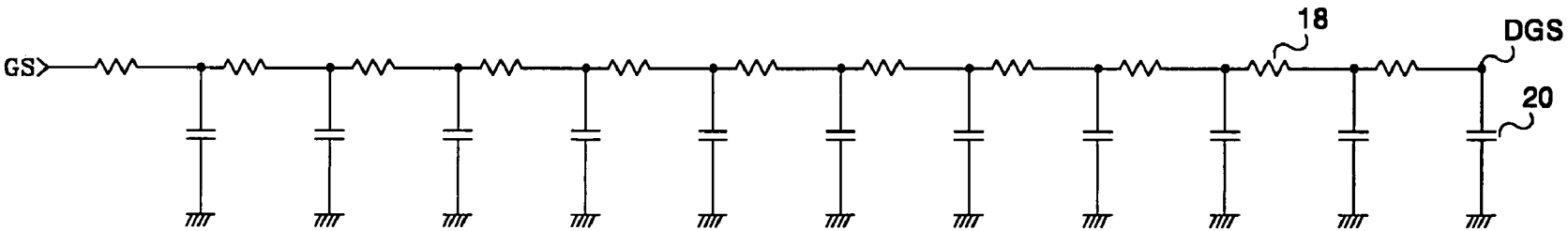
FIG.3 PRIOR ART
FIG. 3 is an equivalent circuit diagram of the scanning wiring for one line shown in FIG. 1.
Figure 4:
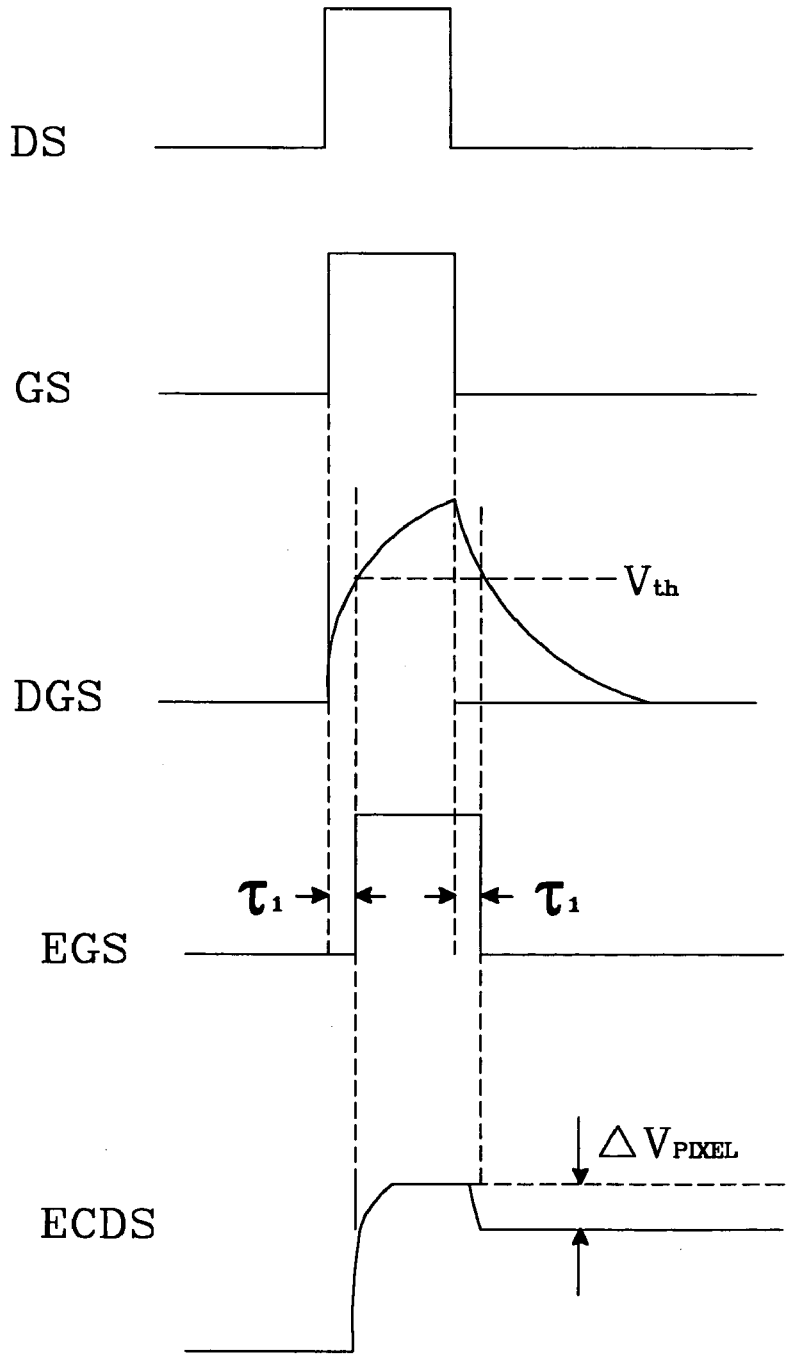
FIG.4 PRIOR ART
FIG. 4 is waveform diagrams of signals applied to a scanning wiring and a signal wiring of the liquid crystal panel according to the conventional liquid crystal panel driving method.
Figure 5:
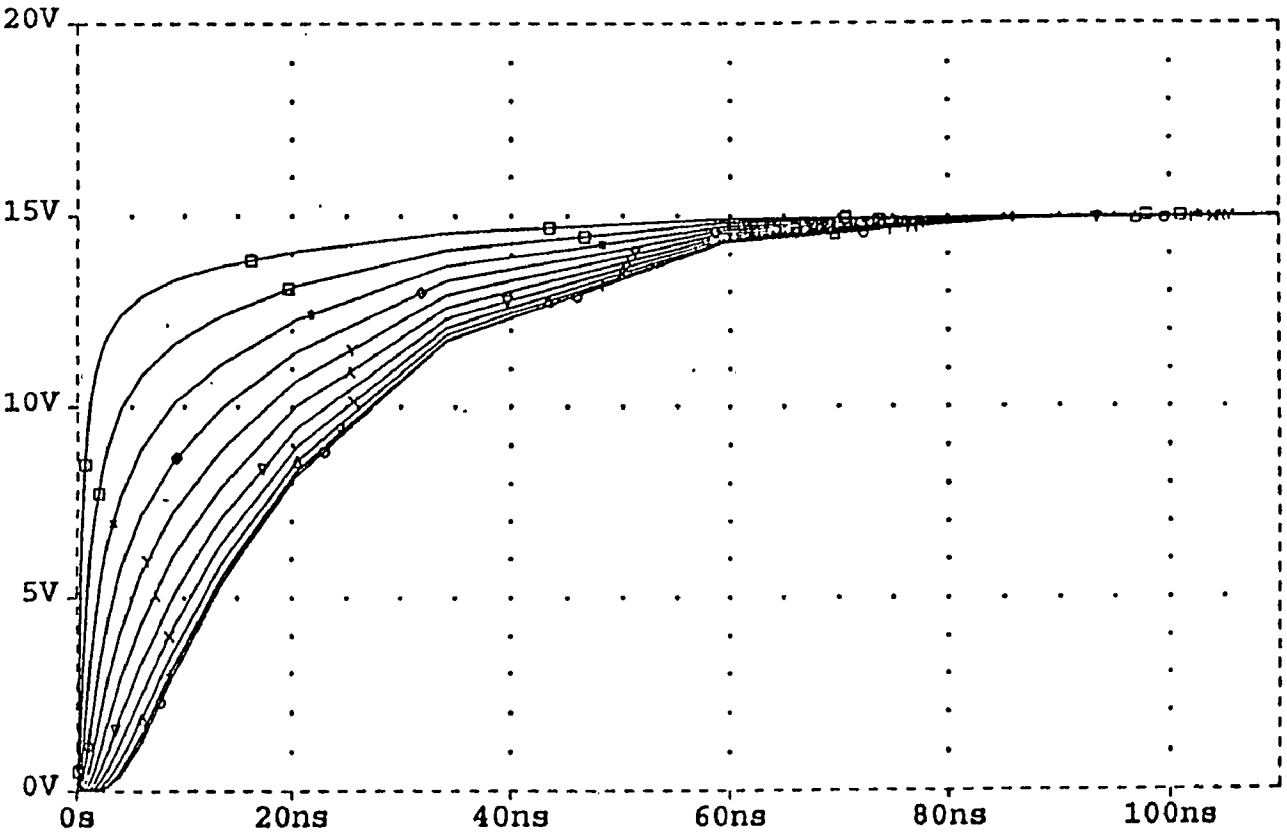
Fig.5 PRIOR ART
FIG. 5 is a response characteristic diagram of the scanning wiring in the rising edge of the scanning voltage according to the conventional liquid crystal panel driving method.
Figure 6:
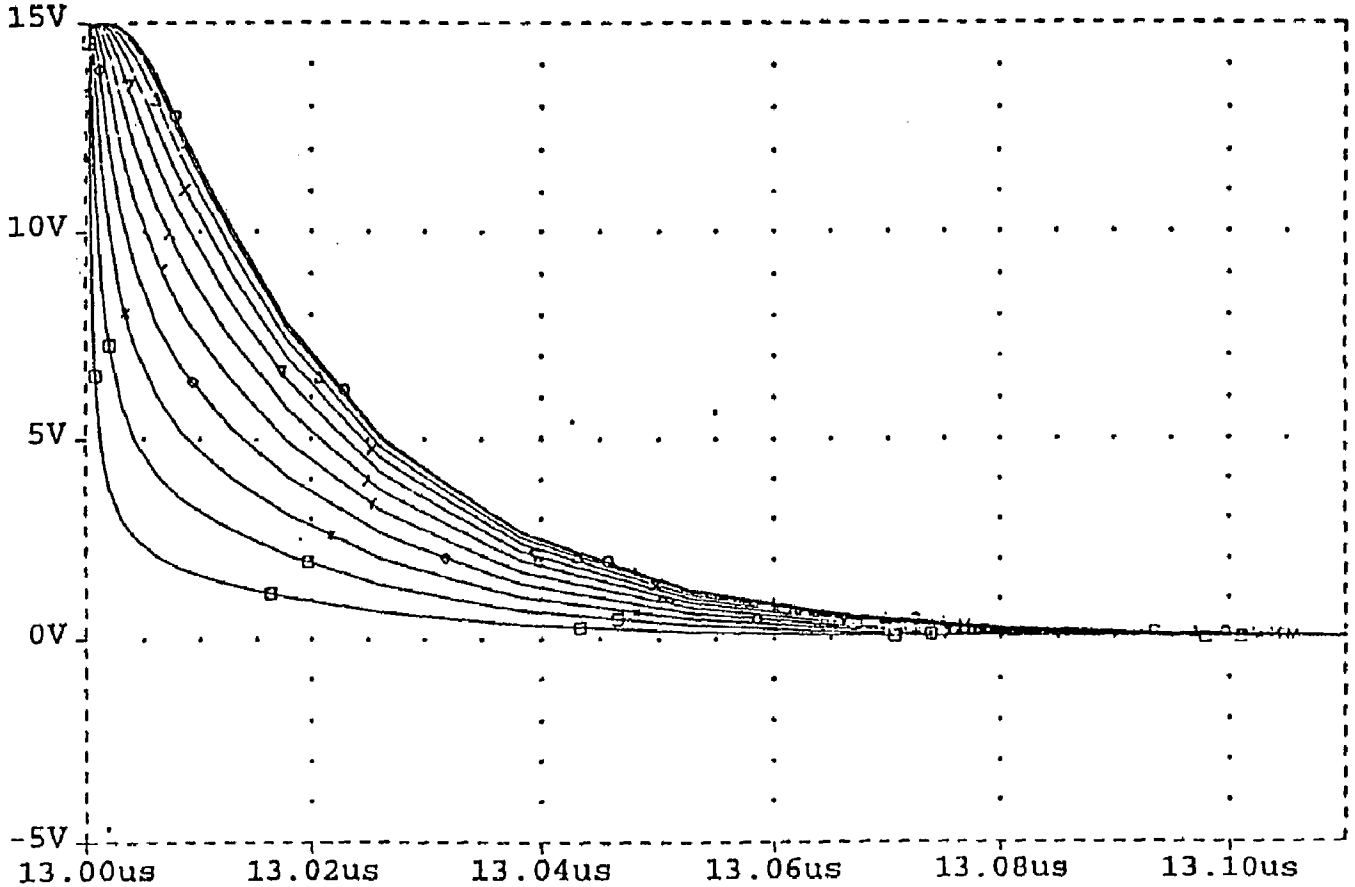
Fig.6 PRIOR ART
FIG. 6 is a response characteristic diagram of the scanning wiring in the falling edge of the scanning voltage according to the conventional liquid crystal panel driving method.
Figure 7:
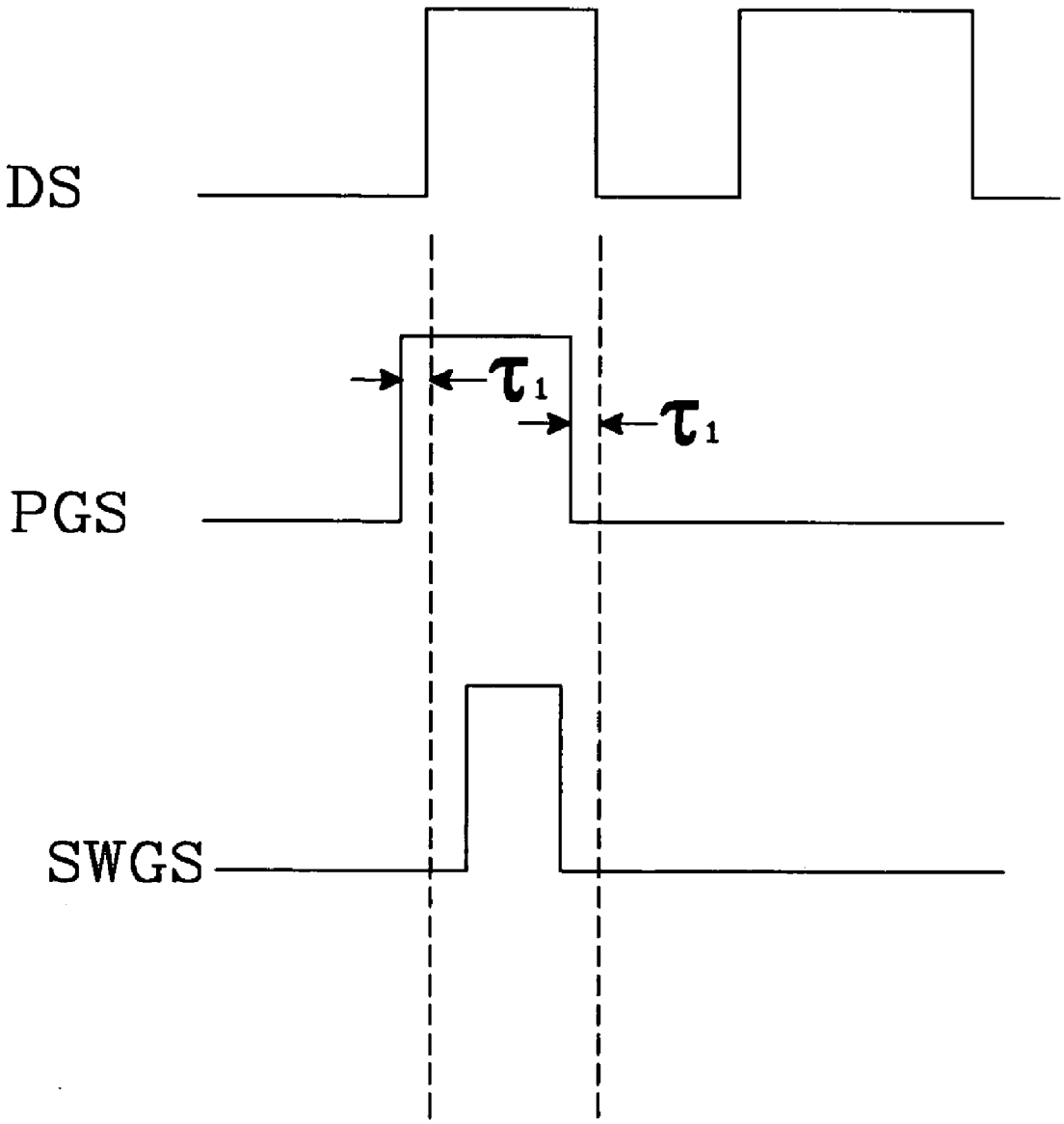
FIG.7 PRIOR ART
FIG. 7 is waveform diagrams of signals applied to a scanning wiring and a signal wiring of the liquid crystal panel according to the prior art pre-scanning method.
Figure 8:
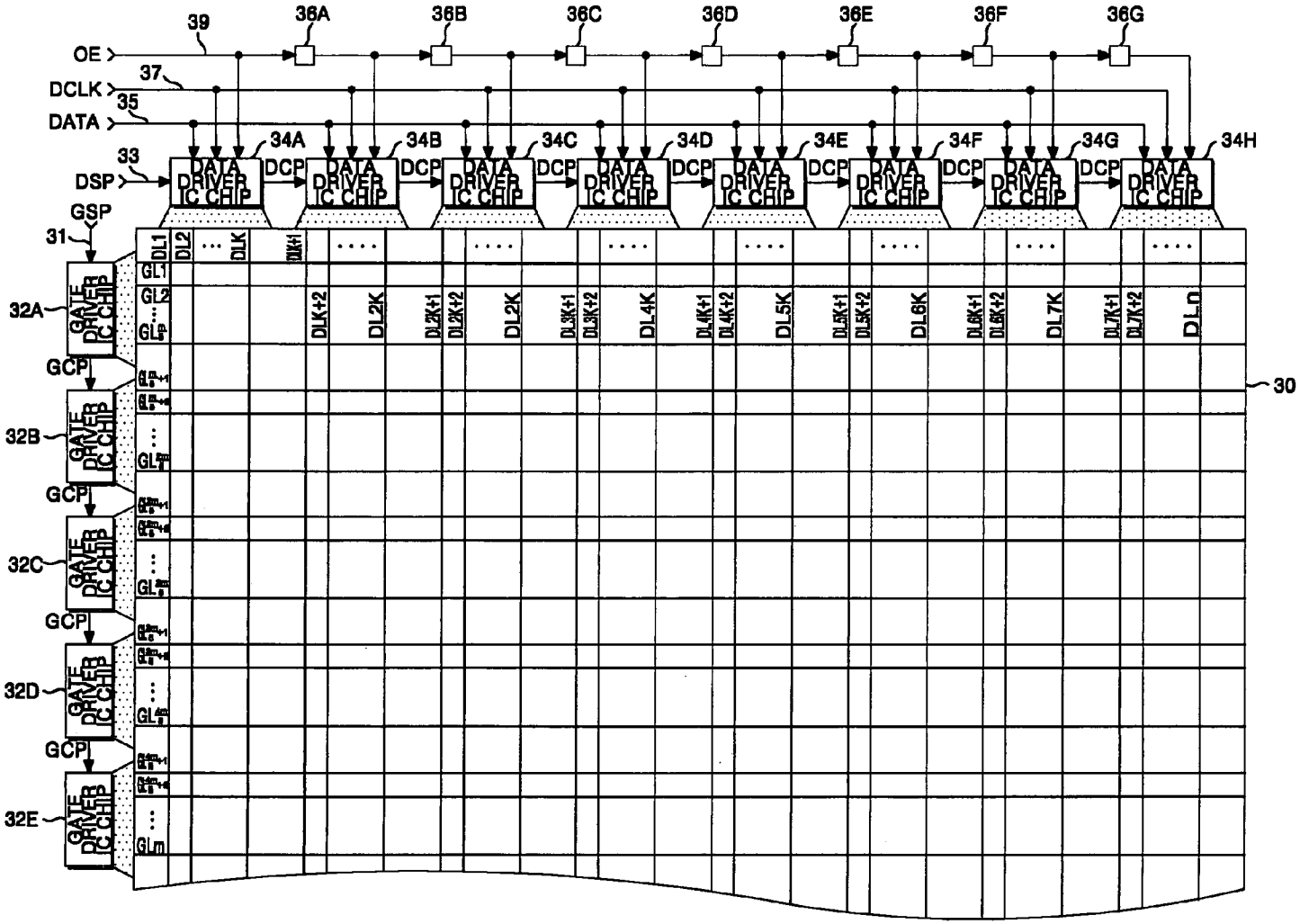
FIG. 8 is a block diagram showing a configuration of a liquid crystal panel driving apparatus according to a first embodiment of the present invention.

Referring to FIG. 8, there is shown a liquid crystal panel driving apparatus according to a first embodiment of the present invention. As shown in FIG. 8, the liquid crystal panel driving apparatus includes gate driver IC (Integrated Circuit) chips 32A to 32E for driving a scanning wiring GL of a liquid crystal panel 30, and data driver IC chips 34A to 34H for driving a signal wiring DL of the liquid crystal panel 30. The scanning wiring GL includes a number of scanning lines, i.e., m scanning lines GL1 to GLm. Gate electrodes of a number of thin film transistors (not shown) are connected to each of the scanning lines GL1 to GLm. The gate driver IC chips 32A to 32E divisionally drives the scanning lines GL1 to GLm. Specifically, the gate driver IC chip 32A sequentially applies a gate signal to the 1st to (m/5)th gate lines GL1 to GLm/5 when a gate start pulse GSP is applied thereto through a gate carry line 31. Then, the 1st to (m/5)th gate lines GL1 to GLm/5 are sequentially driven with a scanning signal applied sequentially from the first gate driver IC chip 32A. Further, the first gate driver IC chip 32A applies a specific logic of gate carry pulse GCP to the carry terminal of the second gate driver IC chip 32B when the (m/5)th gate line GLm/5 is driven. The second gate driver IC chip 32B is responsive to the gate carry pulse GCP from the first gate driver IC chip 32A to sequentially apply the scanning signal to the (m/5+1)th to (2 m/5)th gate lines GL{(m/5)+1} to GL2 m/5. The (m/5+1)th to (2 m/5)th gate lines GL{(m/2)+1} to GL2 m/5 are sequentially driven with the scanning signal applied sequentially from the second gate driver IC chip 32B. Further, the second gate driver IC chip 32B generates the gate carry pulse GCP like the first gate driver IC chip 32A, after the mth gate line GLm was driven, and applies it to third gate driver IC chip 32C. Similarly to the second gate driver IC chip 32B, The third to fifth gate driver IC chips 32C each responds to the gate carry pulse GCP and drives sequentially scanning lines GL{(2 m/5)+1} to GLm for m/5. Meanwhile, the signal wiring DL includes a number of data lines, i.e., n data lines DL1 to DLn, which intersect with the gate lines GL1 to GLm and are arranged in parallel. Source terminals of a number of thin film transistors are connected to each of the data lines DL1 to DLn. The data lines DL1 to DLn are divisionally driven by the K units with the data driver IC chips 32A to 32H. In other words, k data lines DL1 to DLk arranged within the first area of the liquid crystal panel 30 are driven with the first data driver IC chip 34A; and k data lines DLk+1 to DL2*k*, DL2*k*+1 to DL3*k*, DL3*k*+1 to DL4*k*, DL4*k*+1 to DL5*k*, DL5*k*+1 to DL6*k*, DL6*k*+1 to DL7*k* and DL7*k*+1 to DLn included in each of the second to eighth areas of the liquid crystal panel 30 are driven with the second to eighth data driver IC chips 34B to 34H, respectively. The first to eighth data driver IC chips 34A to 34H sequentially receive data for k data lines from a data bus 35. To this end, the first to eighth data driver IC chips 34A to 34H are connected, in series, to a start line 33 and, simultaneously, connected, in parallel, to the data bus 35 and a clock line 37. A data input process of the first to eighth data driver IC chips 34A to 34H will be described in detail below. The first data driver IC chip 34A receives data for k data lines from the data bus 35 in conformity to a data clock DCLK from the clock line 37 when a data start pulse DSP is applied from the data start line 33. When the data for k data lines are input, the first data driver IC chip 34A generates a data carry pulse DCP and applies the data carry pulse DCP to the second data driver IC chip 34B. The second data driver IC chip 34B receives data for k data lines using the data clock DCLK from the clock line 37 when the data carry pulse DCP is applied from the first data driver IC chip 34A. Further, the second data driver IC chip 34B applies the data carry pulse DCP to the third data driver IC chip 34C after the data for k data lines were input. The third to eighth data driver IC chips 34C to 34H connected, in series, to the second data driver IC chip 34B are sequentially driven in similarity to the second data driver IC chip 34B and receives data for k data lines each. Furthermore, each of the first to eighth data driver IC chips 34A to 34H applies a data signal to each of the k data lines when an output enable signal OE is applied. The data signal applied to each of the data lines DL1 to DLn is generated by converting data into analog signal and correcting it.

Figure 9:
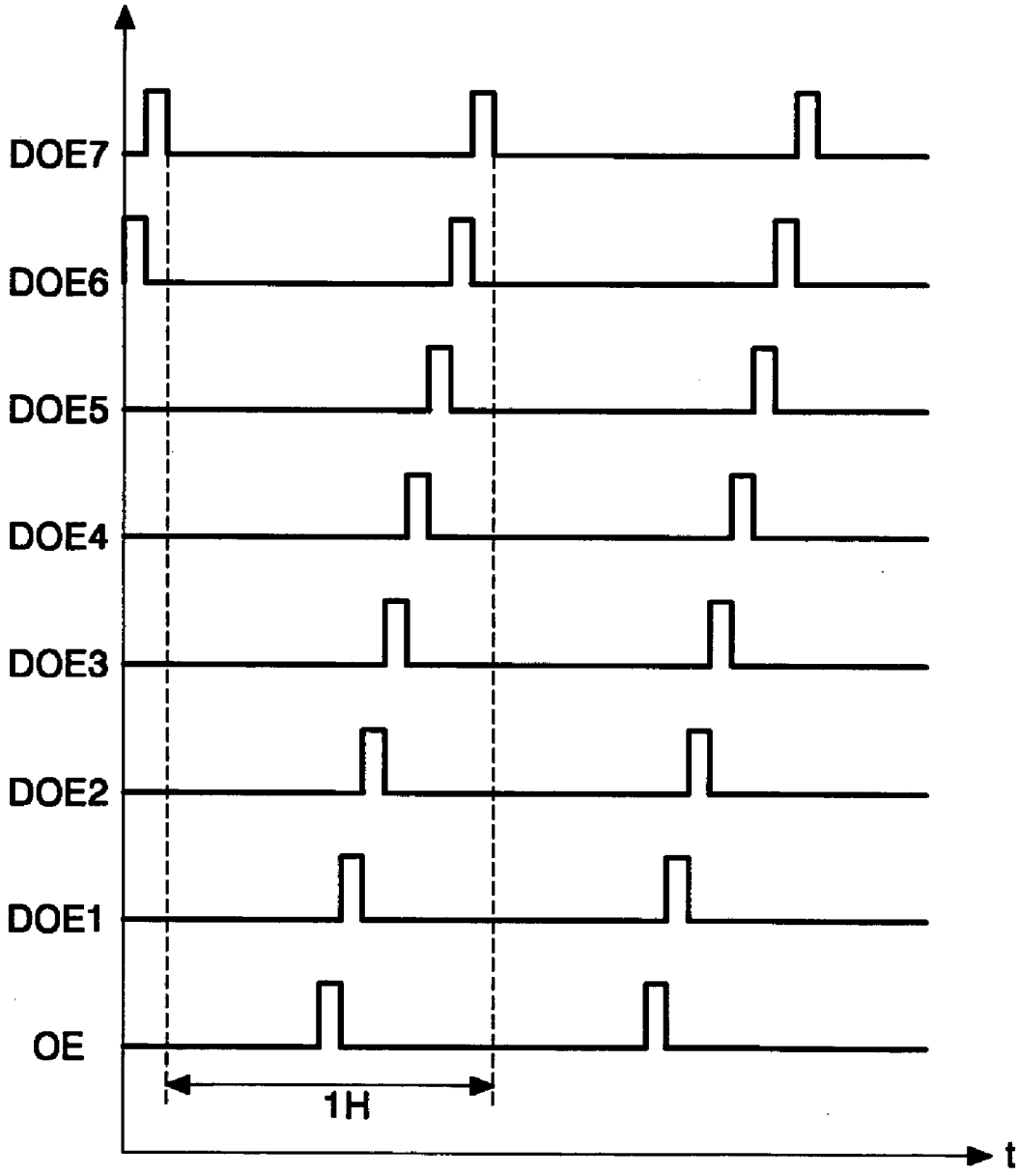
FIG. 9 is a timing chart of output enable signals applied to each data driver IC chip shown in FIG. 8.

The liquid crystal panel driving apparatus further includes first to seventh delay circuit 36A to 36G connected, in series, between an enable line 39 connected to the first data driver IC chip 34A and the seventh data driver IC chip 34G. The first delay circuit 36A firstly delays an output enable signal OE, as shown in FIG. 9, from the enable line 39 by a predetermined interval, and applies the firstly delayed output enable signal DOE1 as shown in FIG. 9 to the second data driver IC chip 34B and the second delay circuit 36B. The second delay circuit 36B secondly delays the firstly delayed enable signal DOE1 by a predetermined interval, and applies the secondly delayed output enable signal DOE2 as shown in FIG. 9 to the third data driver IC chip 34C and the third delay circuit 36C. The third delay circuit 36C thirdly delays the secondly delayed enable signal DOE2 by a predetermined interval, and applies the thirdly delayed output enable signal DOE3 as shown in FIG. 9 to the fourth data driver IC chip 34D and the fourth delay circuit 36D. The fourth delay circuit 36D fourthly delays the thirdly delayed enable signal DOE3 by a predetermined interval, and applies the fourthly delayed output enable signal DOE4 as shown in FIG. 9 to the fifth data driver IC chip 34E and the fifth delay circuit 36E. The fifth delay circuit 36E fifthly delays the fourthly delayed enable signal DOE4 by a predetermined interval, and applies the fifthly delayed output enable signal DOE5 as shown in FIG. 9 to the sixth data driver IC chip 34F and the sixth delay circuit 36F. The sixth delay circuit 36F sixthly delays the fifthly delayed enable signal DOE5 by a predetermined interval, and applies the sixthly delayed output enable signal DOE6 as shown in FIG. 9 to the seventh data driver IC chip 34G and the seventh delay circuit 36G. The seventh delay circuit 36G seventhly delays the sixthly delayed enable signal DOE6 by a predetermined interval, and applies the seventhly delayed output enable signal DOE7 as shown in FIG. 9 to the eighth data driver IC chip 34H. The eight output enable signals OE and DOE1 to DOE7 enabled sequentially by the predetermined interval using the first to seventh delay circuits 36A to 36G are applied to the first to eighth data driver IC chips 34A to 34H, respectively. The respective first to eighth data driver IC chips 34A to 34H output k data signals with a time corresponding to the predetermined interval using the eight output enable signals OE and DOE1 to DOE5. A delay time in each delay circuit 36A to 36H is set to correspond to an interval when a scanning signal transferred over the gate line passes through a distance arranged with k data lines. Accordingly, even when a scanning signal transferred from the start point of gate line GL (i.e., the beginning portion of the first area) into the final point of gate line GL (i.e., the terminating portion of the six area) is delayed, data signals are applied to the data lines in such a manner to be synchronized with the delayed scanning signal. As a result, an accurate data signal is applied to each of cells included in the liquid crystal panel 30, and hence a picture displayed on the liquid crystal panel 30 is not distorted.

Figure 10:
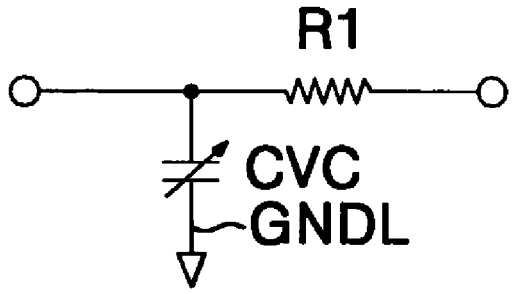
FIG. 10 is a detailed circuit diagram of a first embodiment of the delay circuit shown in FIG. 8.

FIG. 10 is a detailed circuit diagram of a first embodiment of the delay circuits 36A to 36G shown in FIG. 8. As shown in FIG. 10, each delay circuit 36A to 36G includes a resistor R1 connected between the input terminal and the output terminal thereof, and a variable capacitor CVC connected between the input terminal and a ground voltage line GNDL. The resistor R1 has a constant resistance value while the variable capacitor CVC has various capacitance values under control of a manufacturer or a user. During a time corresponding to the product of the capacitance value of the variable capacitor CVC by the resistance value of the resistor R1, the output enable signal OE applied to the input terminal is delayed. The delay circuits 36A to 36G constructed in this manner properly respond to a delay characteristic variation of the gate line GL.

Figure 11:
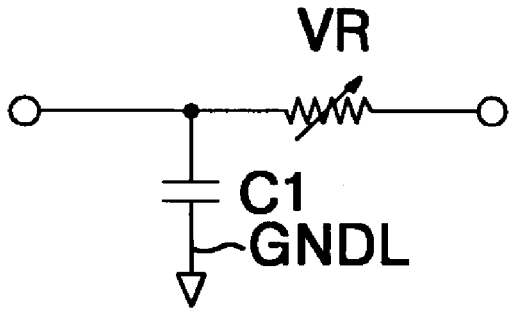
FIG. 11 is a detailed circuit diagram of a second embodiment of the delay circuit shown in FIG. 8.

FIG. 11 is a detailed circuit diagram of another embodiment of the delay circuits 36A to 36G shown in FIG. 8. As shown in FIG. 11, each delay circuit 36A to 36G includes a variable resistor VR connected between the input terminal and the output terminal thereof, and a capacitor C1 connected between the input terminal and a ground voltage line GNDL. The capacitor C1 has a constant capacitance value while the variable resistor VR has various resistance values under control of a manufacturer or a user. During a time corresponding to the product of the capacitance value of the capacitor C1 by the resistance value of the variable resistor VR, the output enable signal OE applied to the input terminal is delayed. Because the resistance value of the variable resistor VR varies, the delay amount of the output enable signal OE is controlled. Accordingly, the delay circuits 36A to 36G respond properly to a delay characteristic variation of the gate line GL.

Figure 12:
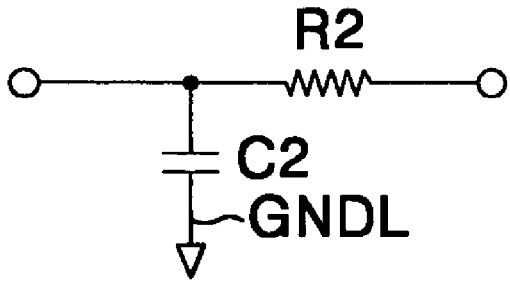
FIG. 12 is a detailed circuit diagram of a third embodiment of the delay circuit shown in FIG. 8.

FIG. 12 is a detailed circuit diagram of still another embodiment of the delay circuits 36A to 36G shown in FIG. 8. As shown in FIG. 12, each delay circuit 36A to 36G includes a resistor R2 connected between the input terminal and the output terminal thereof, and a capacitor C2 connected between the input terminal and a ground voltage line GNDL. The resistor R2 and the capacitor C2 have a constant resistance value and a constant capacitance value, respectively. A delay amount of the output enable signal OE caused by the capacitor C2 and the resistor R2 is fixed constantly. Also, the delay amount of the output enable signal OE is determined by a delay time of the scanning signal in a distance arranged with k data lines DL in accordance with the product of the resistance value of the resistor R2 by the capacitance value of the capacitor C2.

Figure 13:
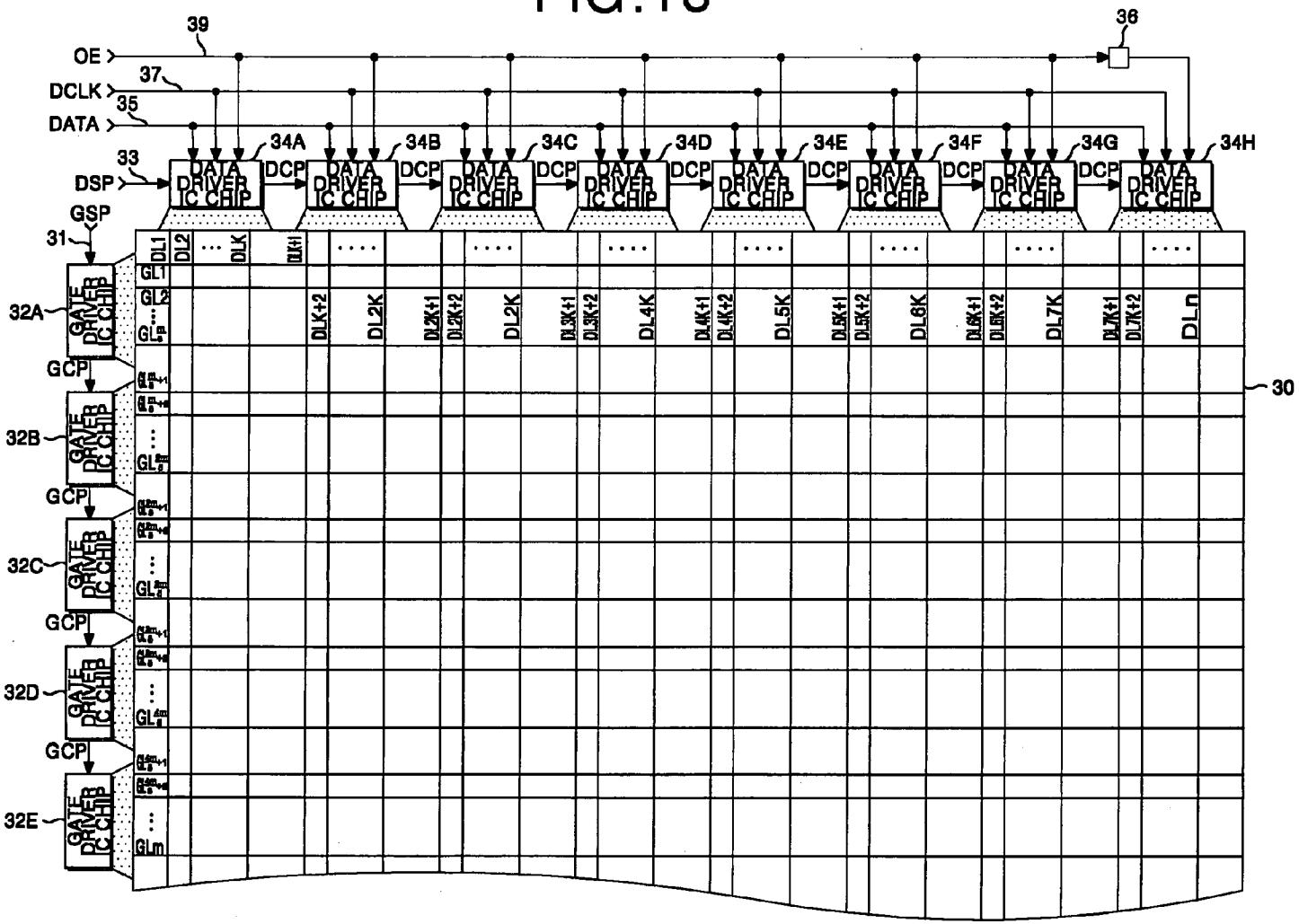
FIG. 13 is a block diagram showing a configuration of a liquid crystal panel driving apparatus according to a second embodiment of the present invention.

Referring now to FIG. 13, there is shown a liquid crystal panel driving apparatus according to a second embodiment of the present invention. As shown in FIG. 13, the liquid crystal panel driving apparatus has a circuit configuration in which the first to seventh delay circuits 36A to 36G in FIG. 8 are replaced by a single of delay circuit 36 and an enable line 39 is commonly connected to first to seventh data driver IC chips 34A to 34G. The delay circuit 36 delays an output enable signal OE from the enable line 39 by a delay time of a scanning signal in a gate line GL and applies the delayed output enable signal to a eighth data driver IC chip 34H. Accordingly, the first to seventh data driver IC chips 34A to 34G apply k data signals to a liquid crystal panel 30 simultaneously, while the eighth data driver IC chip 34H applies k data signals to the liquid crystal panel 30 after a delay time in the gate line GL. According to this operation, a data signal is accurately applied to each of cells included in the liquid crystal panel 30. As a result, a picture displayed on the liquid crystal panel 30 is not distorted. The liquid crystal panel driving apparatus according to another embodiment of the present invention as described above has a simplified circuit configuration compared with the liquid crystal panel driving apparatus in FIG. 8. Also, when a variable type delay circuit as shown in FIG. 10 or FIG. 11 is used as the delay circuit 36, a liquid crystal panel driving apparatus according to another embodiment of the present invention can adaptively respond to the delay characteristic variation of the gate line.

Figure 14:
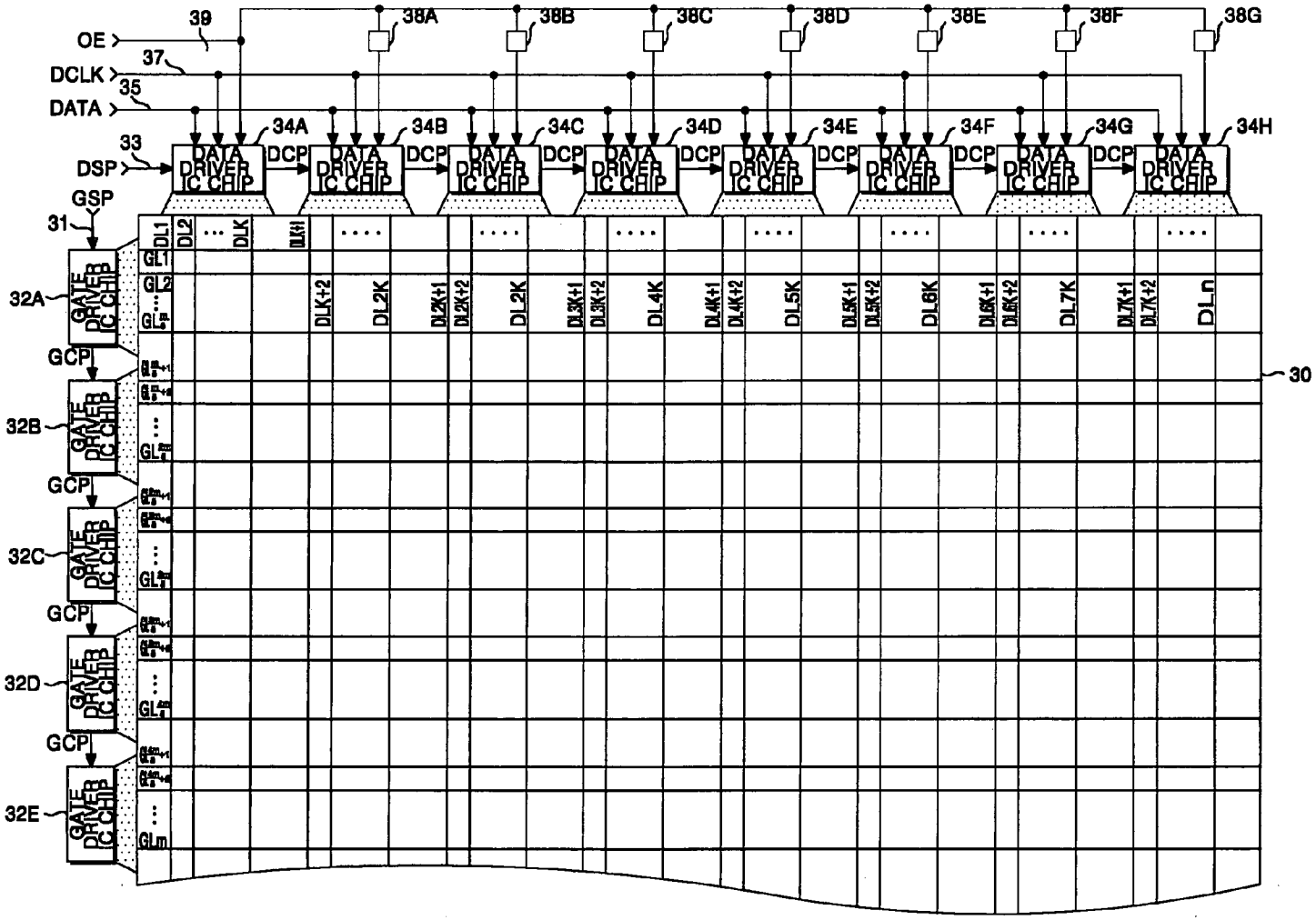
FIG. 14 is a block diagram showing a configuration of a liquid crystal panel driving apparatus according to a third embodiment of the present invention.

Referring now to FIG. 14, there is shown a liquid crystal panel driving apparatus according to a third embodiment of the present invention. As shown in FIG. 14, the liquid crystal panel driving apparatus includes gate driver IC chips 32A to 32E for driving a scanning wiring GL of a liquid crystal panel 30, and data driver IC chips 34A to 34H for driving a signal wiring DL of the liquid crystal panel 30. The scanning wiring GL includes a number of scanning lines, i.e., m scanning lines GL1 to GLm. Gate electrodes of a number of thin film transistors (not shown) are connected to each of the scanning lines GL1 to GLm. The gate driver IC chips 32A to 32E divisionally drives the scanning lines GL1 to GLm. Specifically, the gate driver IC chip 32A sequentially applies a gate signal to the 1st to (m/5)th gate lines GL1 to GLm/5 when a gate start pulse GSP is applied thereto through a gate carry line 31. Then, the 1st to (m/5)th gate lines GL1 to GLm/5 are sequentially driven with a scanning signal applied sequentially from the first gate driver IC chip 32A. Further, the first gate driver IC chip 32A applies a specific logic of gate carry pulse GCP to the carry terminal of the second gate driver IC chip 32B when the (m/5)th gate line GLm/5 is driven. The second gate driver IC chip 32B is responsive to the gate carry pulse GCP from the first gate driver IC chip 32A to sequentially apply the scanning signal to the (m/5+1)th to (2 m/5)th gate lines GL{(m/5)+1} to GL2 m/5. The (m/5+1)th to (2 m/5)th gate lines GL{(m/2)+1} to GL2 m/5 are sequentially driven with the scanning signal applied sequentially from the second gate driver IC chip 32B. Further, the second gate driver IC chip 32B generates the gate carry pulse GCP like the first gate driver IC chip 32A, after the mth gate line GLm was driven, and applies it to third gate driver IC chip 32C. In Similar to the second gate driver IC chip 32B, The third to fifth gate driver IC chips 32C each responds to the gate carry pulse GCP and drives sequentially scanning lines GL{(2 m/5)+1} to GLm for m/5. Meanwhile, the signal wiring DL includes a number of data lines, i.e., n data lines DL1 to DLn, which intersect with the gate lines GL1 to GLm and are arranged in parallel. Source terminals of a number of thin film transistors are connected to each of the data lines DL1 to DLn. The data lines DL1 to DLn are divisionally driven by the K units with the data driver IC chips 32A to 32H. In other words, k data lines DL1 to DLk arranged within the first area of the liquid crystal panel 30 are driven with the first data driver IC chip 34A; and k data lines DLk+1 to DL2*k*, DL2*k*+1 to DL3*k*, DL3*k*+1 to DL4*k*, DL4*k*+1 to DL5*k*, DL5*k*+1 to DL6*k*, DL6*k*+1 to DL7*k* and DL7*k*+1 to DLn included in each of the second to eighth areas of the liquid crystal panel 30 are driven with the second to eighth data driver IC chips 34B to 34H, respectively. The first to eighth data driver IC chips 34A to 34H sequentially receive data for k data lines from a data bus 35. To this end, the first to eighth data driver IC chips 34A to 34H are connected, in series, to a start line 33 and, simultaneously, connected, in parallel, to the data bus 35 and a clock line 37. A data input process of the first to eighth data driver IC chips 34A to 34H will be described in detail below. The first data driver IC chip 34A receives data for k data lines from the data bus 35 in conformity to a data clock DCLK from the clock line 37 when a data start pulse DSP is applied from the data start line 33. When the data for k data lines are input, the first data driver IC chip 34A generates a data carry pulse DCP and applies the data carry pulse DCP to the second data driver IC chip 34B. The second data driver IC chip 34B receives data for k data lines using the data clock DCLK from the clock line 37 when the data carry pulse DCP is applied from the first data driver IC chip 34A. Further, the second data driver IC chip 34B applies the data carry pulse DCP to the third data driver IC chip 34C after the data for k data lines were input. The third to eighth data driver IC chips 34C to 34H connected, in series, to the second data driver IC chip 34B are sequentially driven in similarity to the second data driver IC chip 34B and receives data for k data lines each. Furthermore, each of the first to eighth data driver IC chips 34A to 34H applies a data signal to each of the k data lines when an output enable signal OE is applied. The data signal applied to each of the data lines DL1 to DLn is generated by converting data into analog signal and correcting it.

Figure 15:
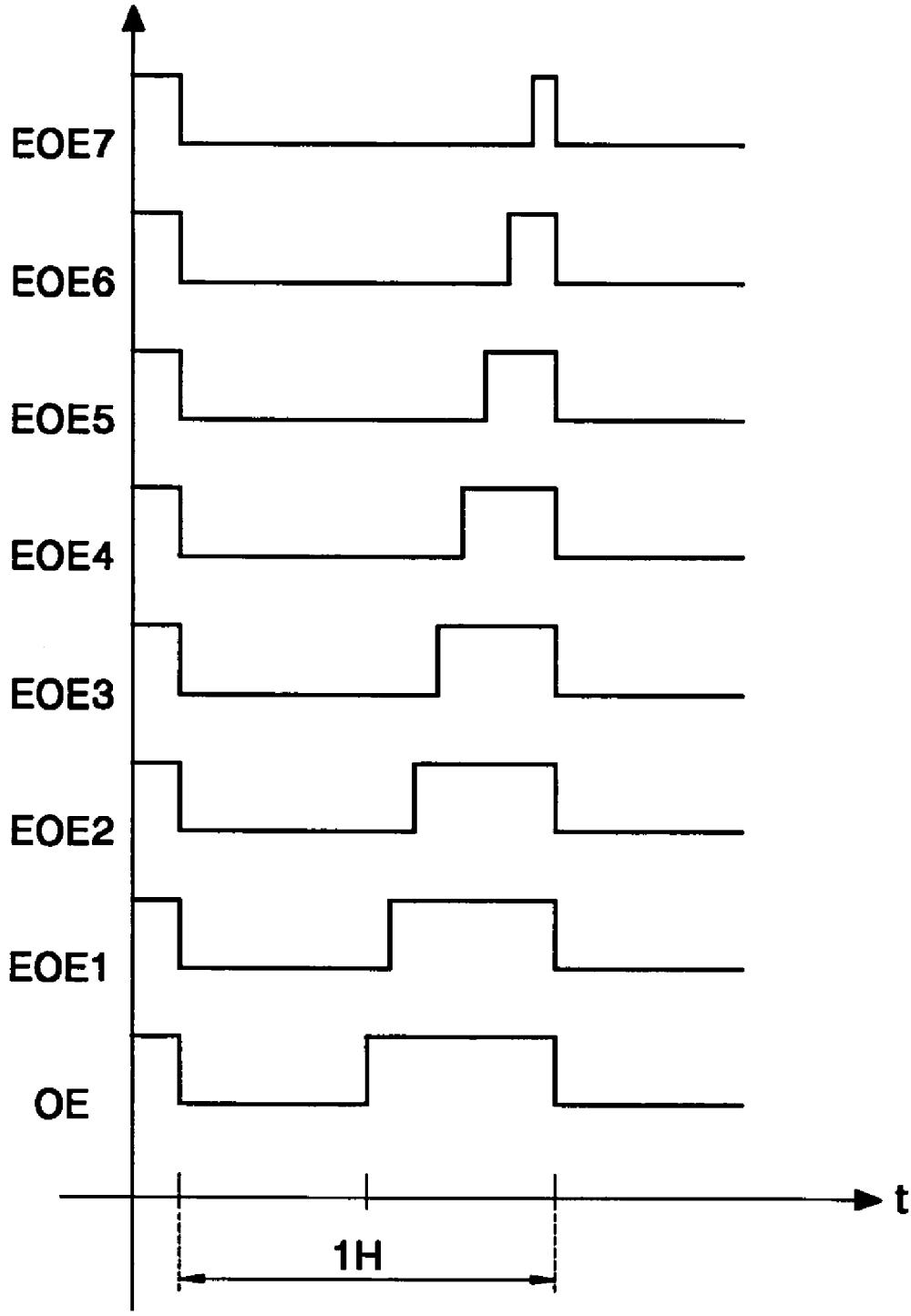
FIG. 15 is a timing chart of output enable signals applied to each data driver IC chip shown in FIG. 14.

The liquid crystal panel driving apparatus further includes first to seventh width expanders 38A to 38G connected between an enable line 39 and the second to eighth data driver IC chips 34B to 34H. The enable line 39 transmits an output enable signal OE to first data driver IC chip 34A as well as the first to seventh width expanders 38A to 38G. The first width expander 38A firstly expands a width of the output enable signal OE, as shown in FIG. 15, from the enable line 39 by a predetermined interval, and applies the firstly expanded output enable signal EOE1 as shown in FIG. 15 to the second data driver IC chip 34B and the second width expander 38B. The second width expander 38B secondly expands a width of the firstly expanded enable signal EOE1 by a predetermined interval, and applies the secondly expanded output enable signal EOE2, as shown in FIG. 15, to the third data driver IC chip 34C and the third width expander 38C. The third width expander 38C thirdly expands a width of the secondly delayed enable signal EOE2 by a predetermined interval, and applies the thirdly expanded output enable signal EOE3, as shown in FIG. 15, to the fourth data driver IC chip 34D and the fourth width expander 38D. The fourth width expander 38D fourthly expands a width of the thirdly expanded enable signal EOE3 by a predetermined interval, and applies the fourthly expanded output enable signal EOE4, as shown in FIG. 15, to the fifth data driver IC chip 34E and the fifth width expander 38E. The fifth width expander 38E fifthly expands a width of the fourthly expanded enable signal EOE4 by a predetermined interval, and applies the fifthly expanded output enable signal EOE5, as shown in FIG. 15, to the sixth data driver IC chip 34F and the sixth width expander 38F. The sixth width expander 38F sixthly expands a width of the fifthly expanded enable signal EOE5 by a predetermined interval, and applies the sixthly expanded output enable signal EOE6, as shown in FIG. 15, to the seventh data driver IC chip 34G and the seventh width expander 38G. The seven width expander 38G seventhly expands a width of the sixthly expanded enable signal EOE6 by a predetermined interval, and applies the seventhly expanded output enable signal EOE7, as shown in FIG. 15, to the eighth data driver IC chip 34G. The eight output enable signals OE and EOE1 to EOE7 having widths to be enlarged by the predetermined interval with the aid of the first to seventh width expanders 38A to 38G are applied to the first to eighth data driver IC chips 34A to 34H, respectively. The respective first to eighth data driver IC chips 34A to 34H responding to each of the eight output enable signals OE and EOE1 to EOE7 output k-unit data signals during an interval corresponding to a width of each output enable signal OE and EOE1 to EOE7. In other words, the first data driver IC chip 34A applies k data signals to k data lines DL1 to DLk on the liquid crystal panel 30 during a time interval corresponding to the width of the output enable signal OE. The second to eighth data driver IC chips 34B to 34H apply k data signals to k data lines DLk+1 to DLn on the liquid crystal panel 30, respectively, during a time interval corresponding to a width enlarged gradually by a predetermined width compared with the width of the output enable signal OE. A width expanded by each of the first to seventh width expanders 38A to 38G is set in such a manner that a scanning signal transferred over the gate line corresponds to a time interval passing through a distance in which k data lines are arranged. Accordingly, even when a scanning signal transferred from the start point of gate line GL (i.e., the beginning portion of the first area) into the final point of gate line GL (i.e., the terminating portion of the eight area) is delayed, data signals are applied to the data lines accurately. As a result, an accurate data signal is applied to each liquid crystal cell (not shown) included in the liquid crystal panel 30, and hence a picture displayed on the liquid crystal panel 30 is not distorted. The first to eighth width expanders 38A to 38G may expand a width of the output enable signal making use of a mono-stable multivibrator.

Figure 16:
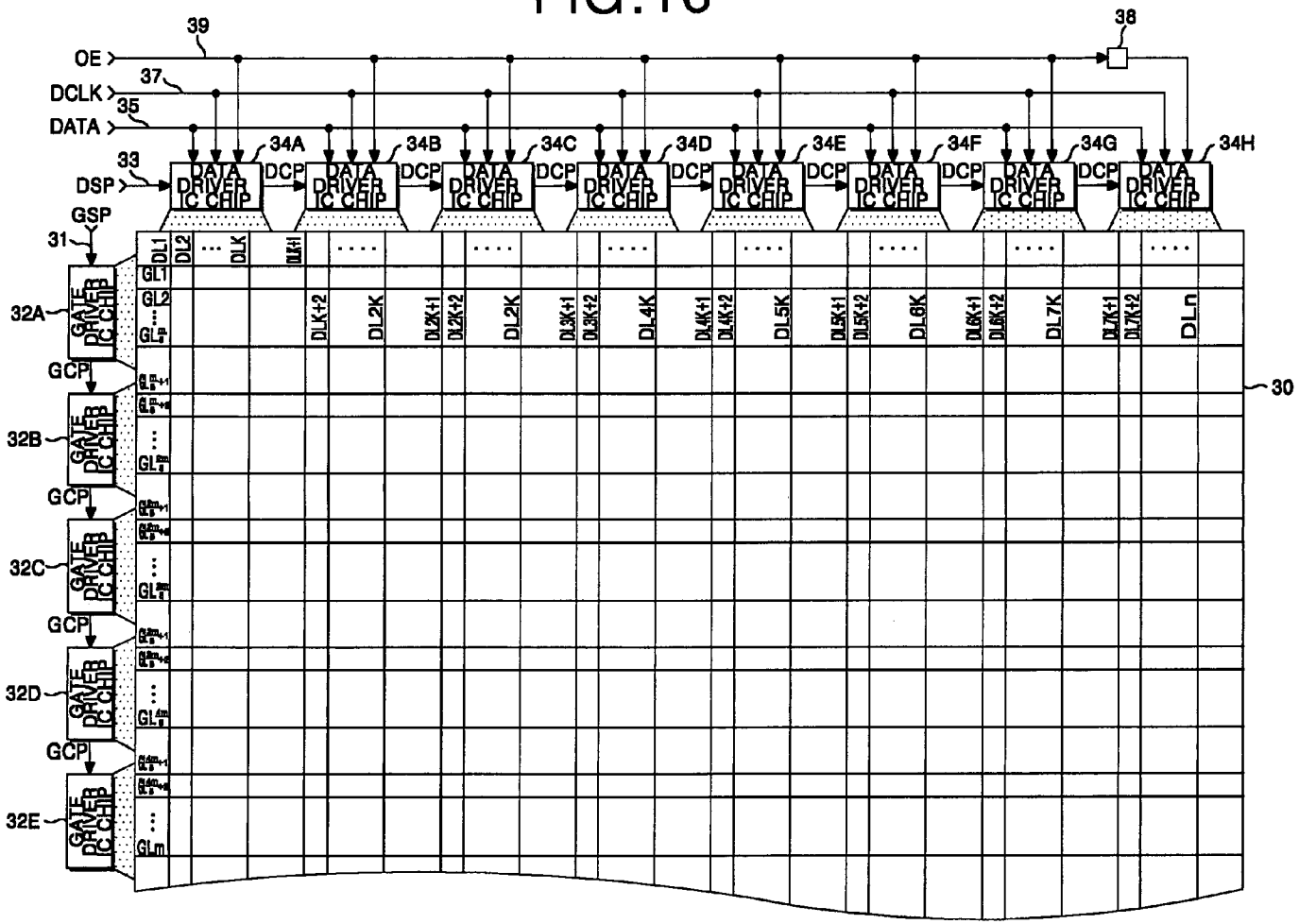
FIG. 16 is a block diagram showing a configuration of a liquid crystal panel driving apparatus according to a fourth embodiment of the present invention.

Referring now to FIG. 16, there is shown a liquid crystal panel driving apparatus according to a fourth embodiment of the present invention. As shown in FIG. 16, the liquid crystal panel driving apparatus has a circuit configuration in which the first to seventh width expanders 38A to 38G in FIG. 14 are replaced by a single of width expander 38 and an enable line 39 is commonly connected to first to seventh data driver IC chips 34A to 34G. The width expander 38 expands a width of an output enable signal OE from the enable line 39 by a width corresponding to a delay time of a scanning signal at a gate line GL and applies the expanded output enable signal to an eighth data driver IC chip 34H. Accordingly, the first to seventh data driver IC chips 34A to 34G apply k-unit data signals to a liquid crystal panel 30; while the eighth data driver IC chip 34H applies k data signals to the liquid crystal panel 30 during a time longer, by a delay time at the gate line GL, than an enabling interval of an output enable signal OE. According to this operation, a data signal is accurately applied to each liquid crystal cell included in the liquid crystal panel 30. As a result, a picture displayed on the liquid crystal panel 30 is not distorted. The liquid crystal panel driving apparatus according to the fourth embodiment of the present invention as described above has a simplified circuit configuration compared with the liquid crystal panel driving apparatus in FIG. 14.

Figure 17:
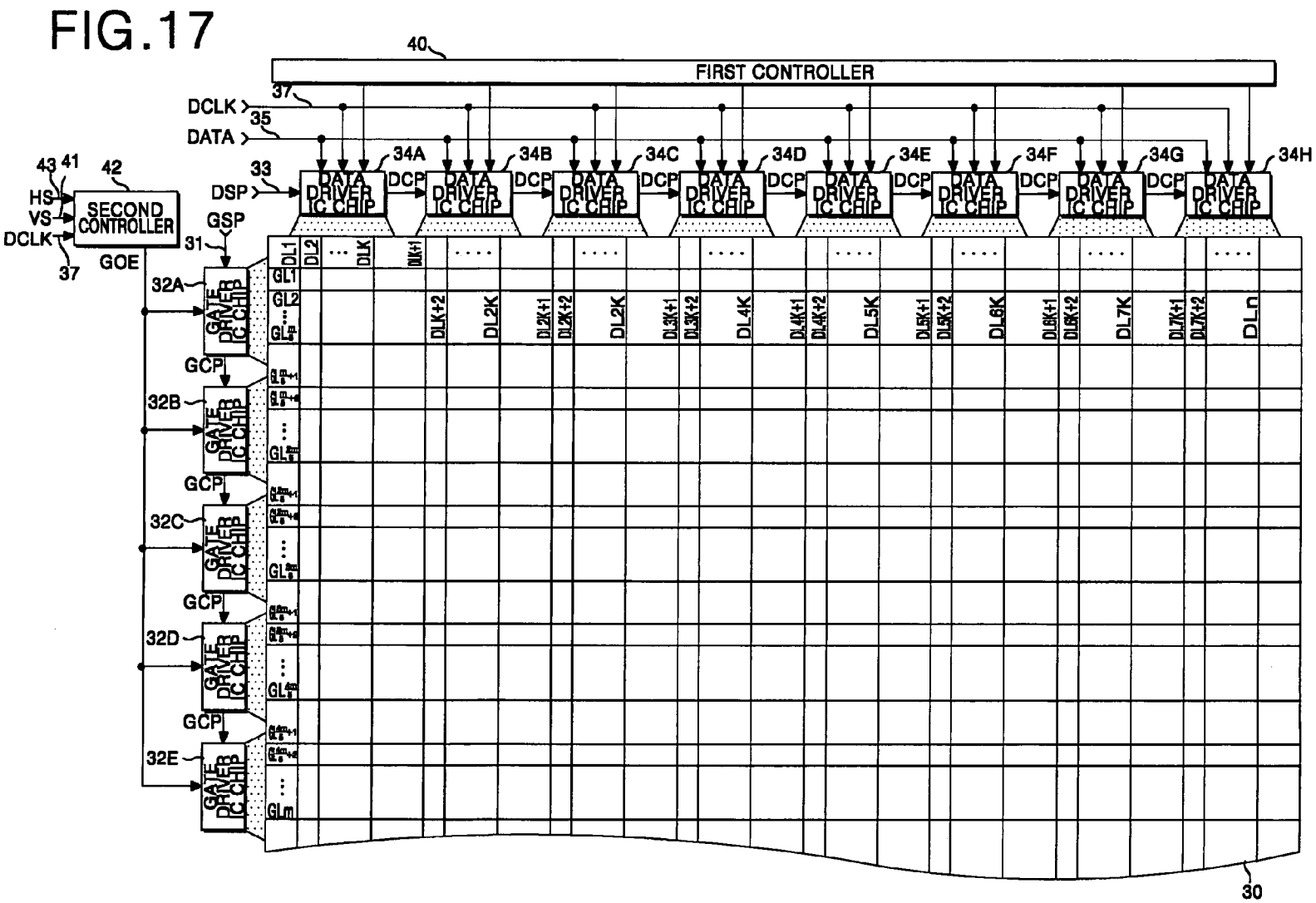
FIG. 17 is a block diagram showing a configuration of a liquid crystal panel driving apparatus according to a fifth embodiment of the present invention.

FIG. 17 illustrates a liquid crystal panel driving apparatus according to a fifth embodiment of the present invention. In FIG. 17, the liquid crystal panel driving apparatus includes gate driver IC chips 32A to 32E for driving a scanning wiring GL of a liquid crystal panel 30, and data driver IC chips 34A to 34H for driving a signal wiring DL of the liquid crystal panel 30. The scanning wiring GL includes a number of scanning lines, i.e., m scanning lines GL1 to GLm. Gate electrodes of a number of thin film transistors (not shown) are connected to each of the scanning lines GL1 to GLm. The gate driver IC chips 32A to 32E divisionally drives the scanning lines GL1 to GLm. Specifically, the gate driver IC chip 32A sequentially applies a gate signal to the 1st to (m/5)th gate lines GL1 to GLm/5 when a gate start pulse GSP is applied thereto through a gate carry line 31. Then, the 1st to (m/5)th gate lines GL1 to GLm/5 are sequentially driven with a scanning signal applied sequentially from the first gate driver IC chip 32A. Further, the first gate driver IC chip 32A applies a specific logic of gate carry pulse GCP to the carry terminal of the second gate driver IC chip 32B when the (m/5)th gate line GLm/5 is driven. The second gate driver IC chip 32B is responsive to the gate carry pulse GCP from the first gate driver IC chip 32A to sequentially apply the scanning signal to the (m/5+1)th to (2 m/5)th gate lines GL{(m/5)+1} to GL2 m/5. The (m/5+1)th to (2 m/5)th gate lines GL{(m/2)+1} to GL2 m/5 are sequentially driven with the scanning signal applied sequentially from the second gate driver IC chip 32B. Further, the second gate driver IC chip 32B generates the gate carry pulse GCP like the first gate driver IC chip 32A, after the mth gate line GLm was driven, and applies it to third gate driver IC chip 32C. In Similar to the second gate driver IC chip 32B, The third to fifth gate driver IC chips 32C each responds to the gate carry pulse GCP and drives sequentially scanning lines GL{(2 m/5)+1} to GLm for m/5. Meanwhile, the signal wiring DL includes a number of data lines, i.e., n data lines DL1 to DLn, which intersect with the gate lines GL1 to GLm and are arranged in parallel. Source terminals of a number of thin film transistors are connected to each of the data lines DL1 to DLn. The data lines DL1 to DLn are divisionally driven by the K units with the data driver IC chips 32A to 32H. In other words, k data lines DL1 to DLk arranged within the first area of the liquid crystal panel 30 are driven with the first data driver IC chip 34A; and k data lines DLk+1 to DL2*k*, DL2*k*+1 to DL3*k*, DL3*k*+1 to DL4*k*, DL4*k*+1 to DL5*k*, DL5*k*+1 to DL6*k*, DL6*k*+1 to DL7*k* and DL7*k*+1 to DLn included in each of the second to eighth areas of the liquid crystal panel 30 are driven with the second to eighth data driver IC chips 34B to 34H, respectively. The first to eighth data driver IC chips 34A to 34H sequentially receive data for k data lines from a data bus 35. To this end, the first to eighth data driver IC chips 34A to 34H are connected, in series, to a start line 33 and, simultaneously, connected, in parallel, to the data bus 35 and a clock line 37. A data input process of the first to eighth data driver IC chips 34A to 34H will be described in detail below. The first data driver IC chip 34A receives data for k data lines from the data bus 35 in conformity to a data clock DCLK from the clock line 37 when a data start pulse DSP is applied from the data start line 33. When the data for k data lines are input, the first data driver IC chip 34A generates a data carry pulse DCP and applies the data carry pulse DCP to the second data driver IC chip 34B. The second data driver IC chip 34B receives data for k data lines using the data clock DCLK from the clock line 37 when the data carry pulse DCP is applied from the first data driver IC chip 34A. Further, the second data driver IC chip 34B applies the data carry pulse DCP to the third data driver IC chip 34C after the data for k data lines were input. The third to eighth data driver IC chips 34C to 34H connected, in series, to the second data driver IC chip 34B are sequentially driven in similarity to the second data driver IC chip 34B and receives data for k data lines each. Furthermore, each of the first to eighth data driver IC chips 34A to 34H applies a data signal to each of the k data lines when an output enable signal OE is applied. The data signal applied to each of the data lines DL1 to DLn is generated by converting data into analog signal and correcting it.

Figure 18:
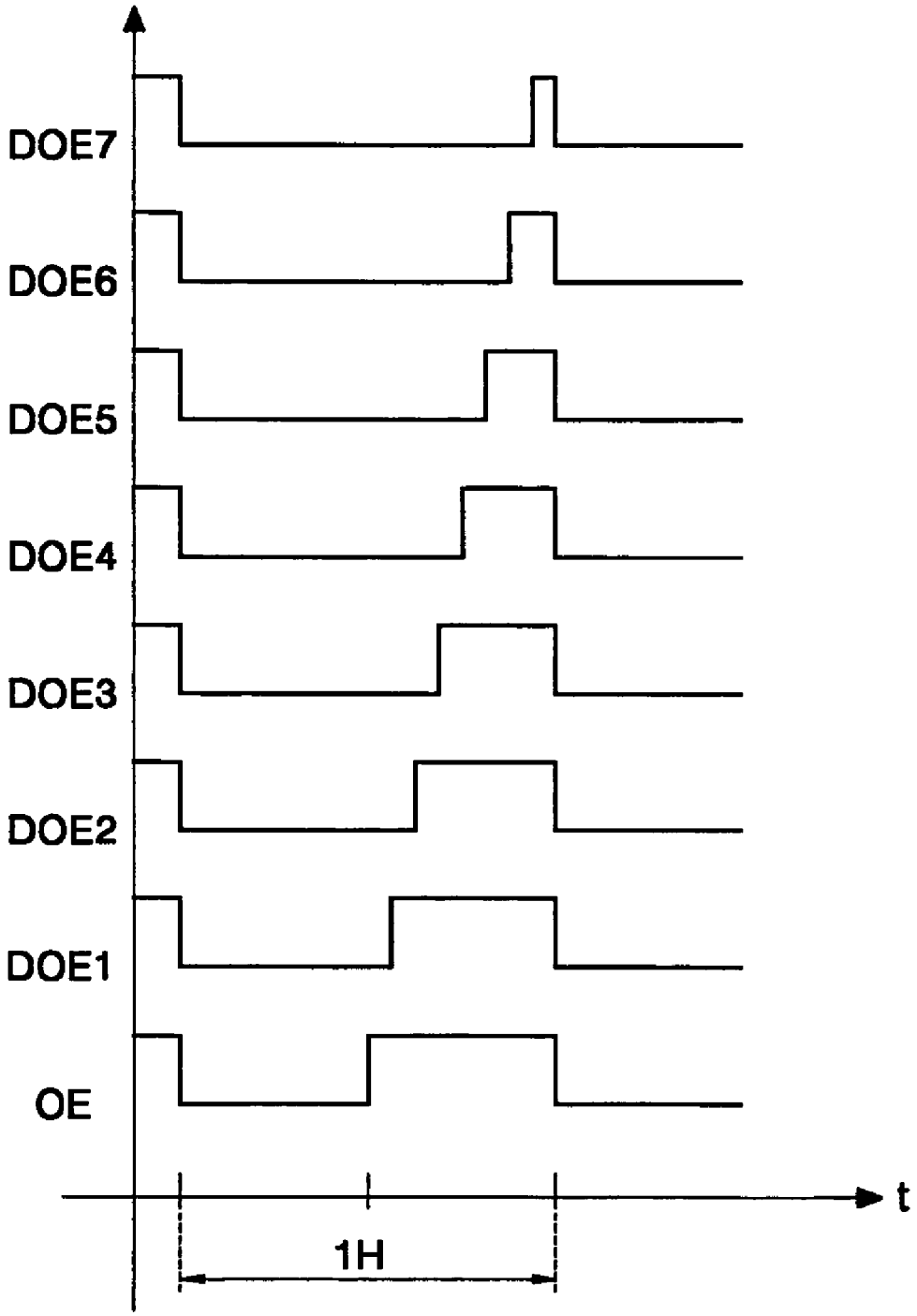
FIG. 18 is a timing chart of output enable signals applied to each data driver IC chip shown in FIG. 17.

The liquid crystal panel driving apparatus further includes first controller 40 connected to the first to eighth data driver IC chip 34A to 34H, and second controller 42 connected to the first to fifth gate driver IC chips 32A to 32E. The first controller 40 generates first to eighth data output enable signals DOE1 to DOE8 as shown in FIG. 18. The second data output enable signal DOE2 is larger than the first data output enable signal DOE1 by a predetermined interval in width. Also, the third to eighth data output enable signals DOE3 to DOE8 are larger than the second to seventh data output enable signals DOE2 to DOE7 by the predetermined interval in width, respectively. The eight data output enable signals DOE1 to DOE8, having widths to be enlarged by the predetermined interval, are applied to the first to eighth data driver IC chips 34A to 34H, respectively. The respective first to eighth data driver IC chips 34A to 34H responding to each of the eight data output enable signals DOE1 to DOE8 output k-unit data signals during an interval corresponding to a width of each data output enable signal DOE1 to DOE8. In other words, the first data driver IC chip 34A applies k data signals to k data lines DL1 to DLk on the liquid crystal panel 30 during a time interval corresponding to the width of the first data output enable signal DOE1. The second to eighth data driver IC chips 34B to 34H apply k data signals to k data lines DLk+1 to DLn on the liquid crystal panel 30, respectively, during a time interval corresponding to a width enlarged gradually by a predetermined width compared with the width of the first data output enable signal DOE1. The predetermined width is set in such a manner that a scanning signal transferred over the gate line corresponds to a time interval passing through a distance in which k data lines are arranged. Accordingly, even when a scanning signal transferred from the start point of gate line GL (i.e., the beginning portion of the first area) into the final point of gate line GL (i.e., the terminating portion of the eight area) is delayed, data signals are applied to the data lines accurately. As a result, an accurate data signal is applied to each liquid crystal cell (not shown) included in the liquid crystal panel 30, and hence a picture displayed on the liquid crystal panel 30 is not distorted. To generate the first to eighth data output enable signals DOE1 to DOE8, the first controller 40 can be composed of the first to seventh width expanders 38A to 38E as shown in FIG. 14. On the other hand, the first controller 40 can receive the data clock DCLK from the clock line 37 and a horizontal synchronous signal from a second synchronous line 43. Also, the first controller 40 can generate the first to eighth data output enable signals DOE1 to DOE8 on the basis of the data clock DCLK and horizontal synchronous signal HS.

Figure 19:
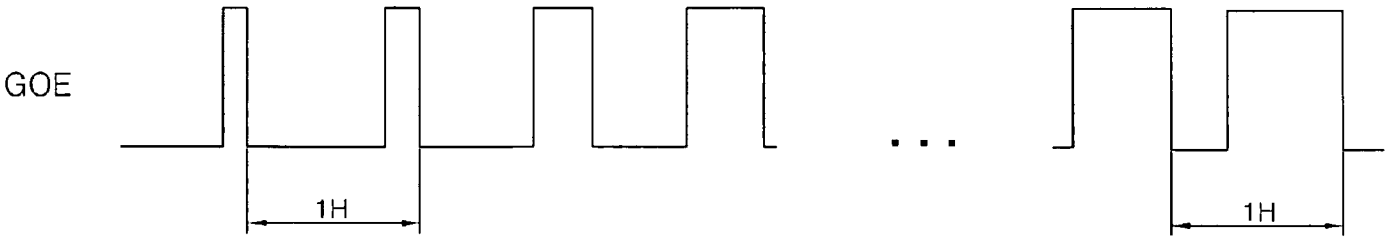
FIG. 19 is a timing chart of gate output enable signal outputting from the second controller shown in FIG. 17.
Figure 20:
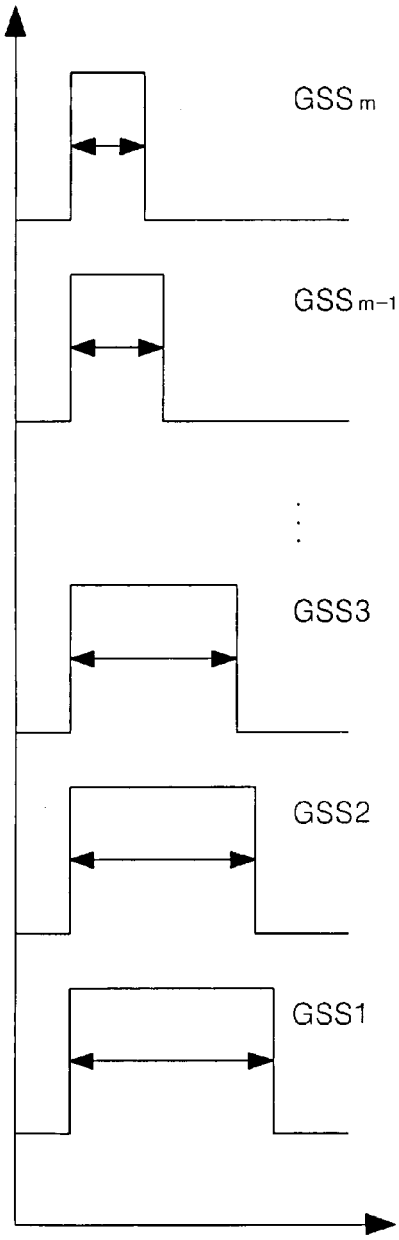
FIG. 20 is a timing chart of scanning signals applied to each scanning line shown in FIG. 17.
Figure 21:
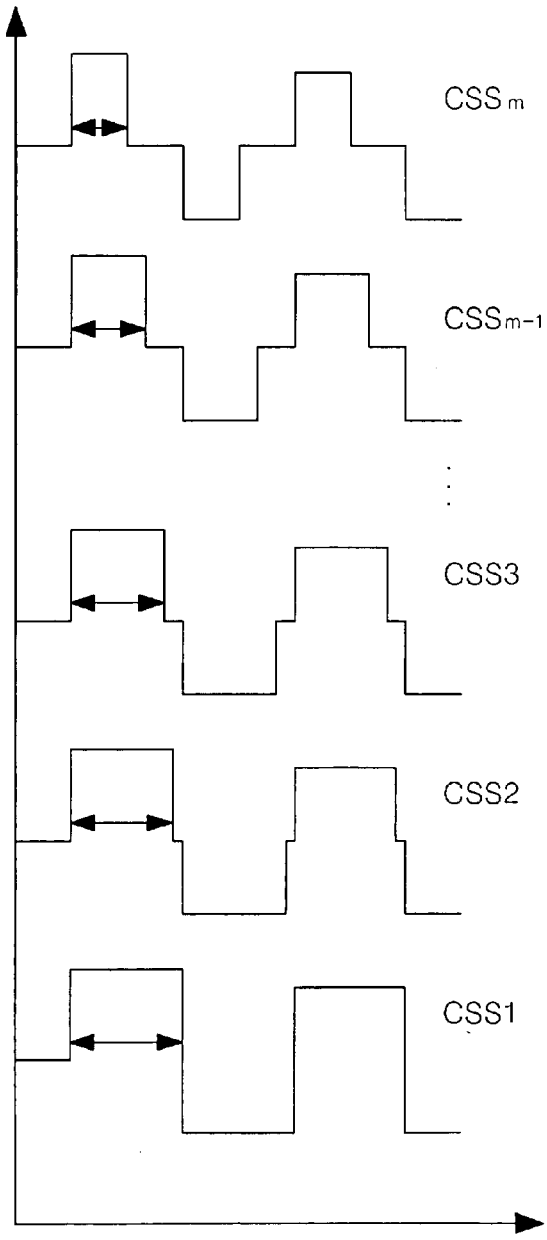
FIG. 21 is a timing chart representing the charging time of each liquid crystal cell on one data line shown in FIG. 17.

Meanwhile, the second controller 42 responds to a vertical synchronous signal VS from first synchronous line 41, the horizontal synchronous signal HS from second synchronous line 43 and the data clock DCLK from the clock line 37. The second controller 42 generates a gate output enable signal GOE, as shown in FIG. 19, on the basis of the data clock DCLK and the horizontal and vertical synchronous signals HS and VS, and applies the gate output enable signal GOE to the first to fifth gate driver IC chips 32A to 32E. The gate output enable signal GOE has an enable width (i.e., a low logic interval) which is gradually decreased every horizontal synchronous period by a predetermined interval, during one vertical synchronous period. The first and fifth gate driver IC chips 32A to 32E responding commonly to the gate output signal GOE from the second controller 42, generate m scanning signals GSS1 to GSSm having widths to be gradually increased decreased by a predetermined interval, as shown in FIG. 20. The m scanning signals GSS1 to GSSm are applied to the m gate lines GL1 to GLm such that signal charging period of each liquid crystal cell connected to one data line DL are gradually reduced by the predetermined interval. In other words, the signal charging period of each liquid crystal cell appears as timing signals CSS1 to CSSm shown in FIG. 21. The predetermined width is set in such a manner that a data signal transferred over the data line corresponds to a time interval passing through a distance in which two gate lines are arranged. Accordingly, even when a data signal transferred from the start point of data line DL (i.e., the top portion) into the final point of data line DL (i.e., the bottom portion) is delayed, the data signals are accurately applied to the liquid crystal cells on the gate lines. Also, the charging time of each the liquid crystal cell on the liquid crystal panel becomes uniform. As a result, an accurate data signal is applied to each liquid crystal cell included in the liquid crystal panel 30, and hence a picture displayed on the liquid crystal panel 30 is not distorted.

Figure 22:
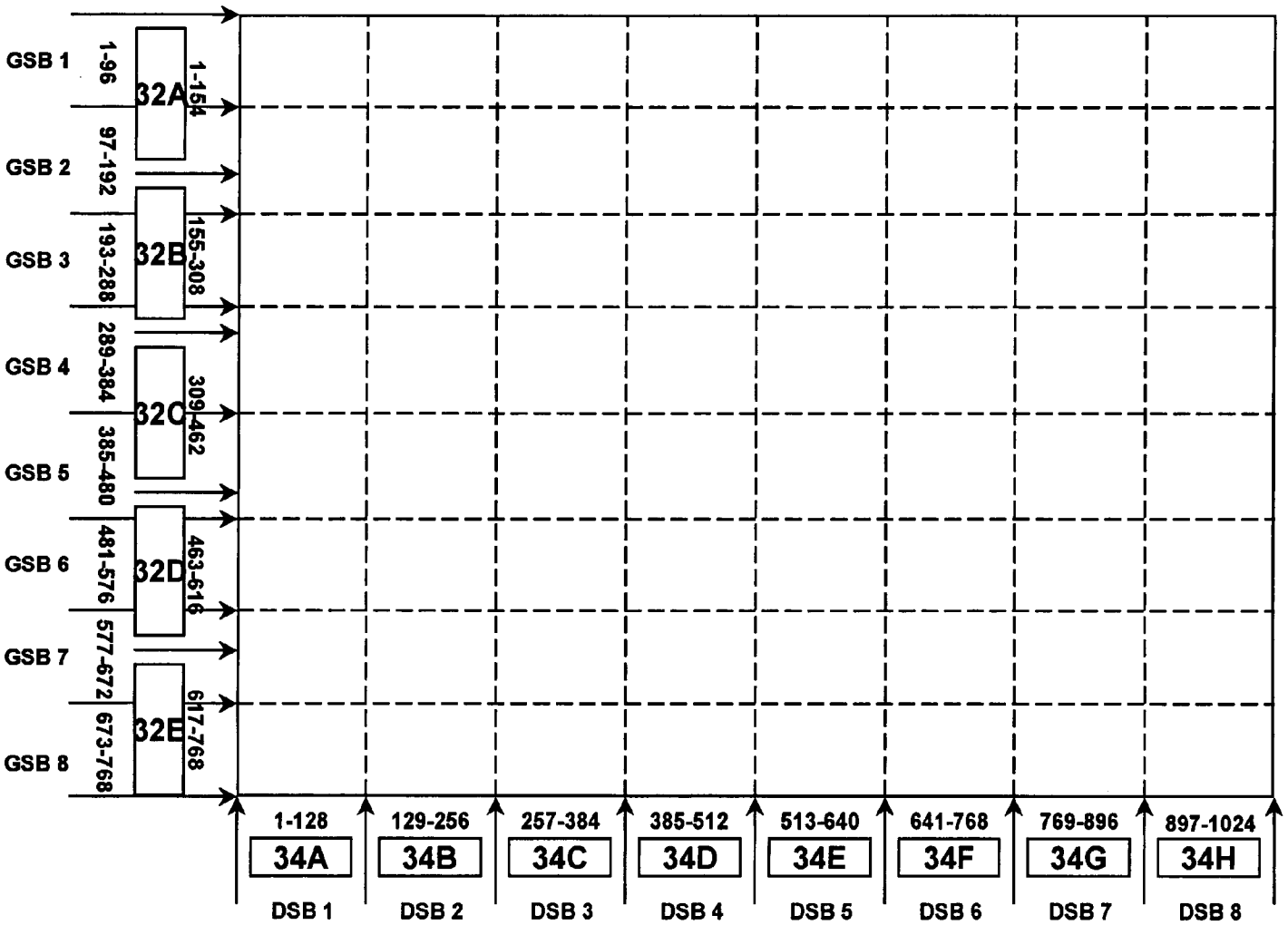
FIG. 22 shows the state of liquid crystal panel divided into a plurality of blocks for the simulation.
Figure 23A:
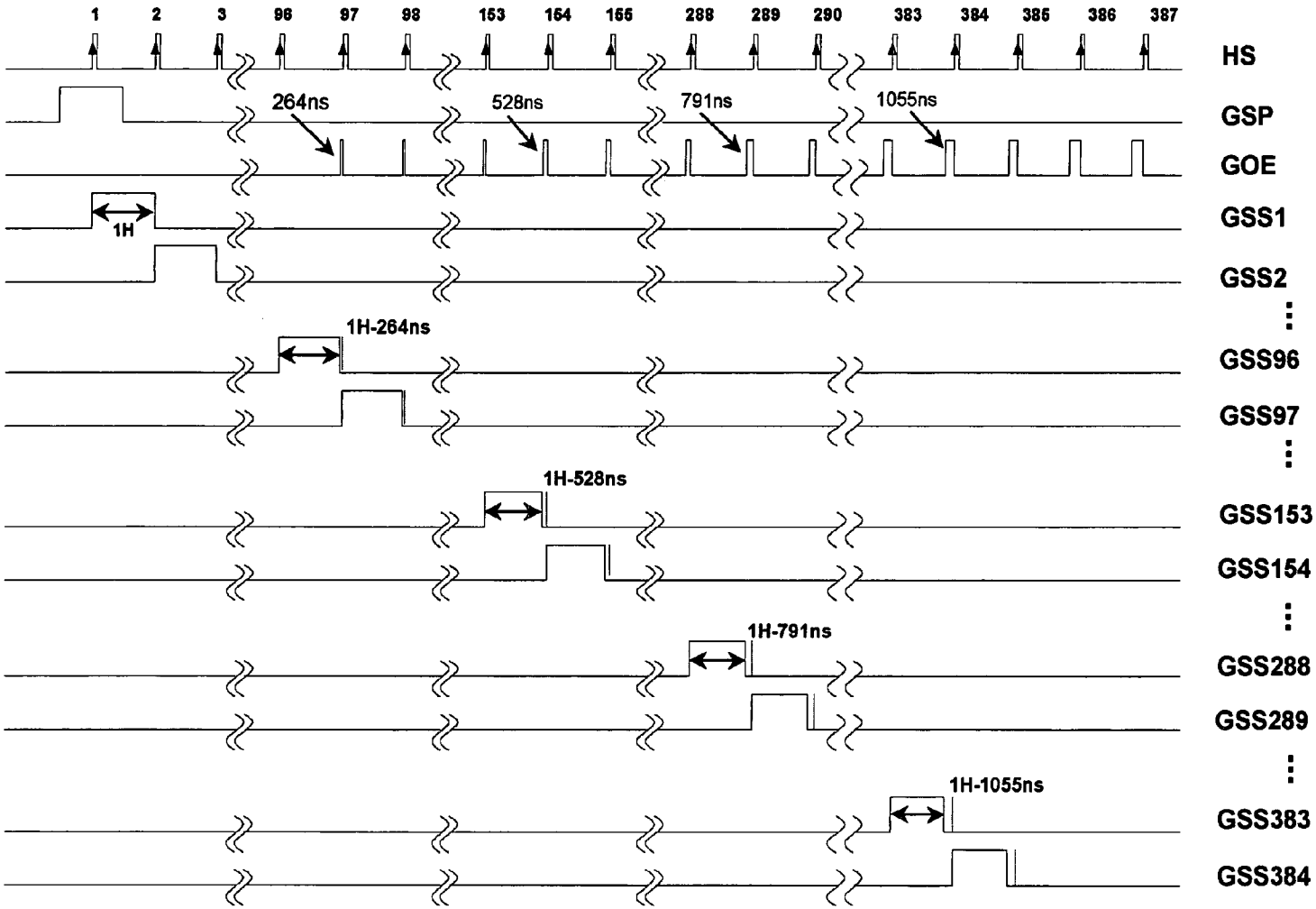
FIG. 23 is a timing chart of the scanning signal applied to the scanning line on the liquid crystal panel shown in FIG. 22.
Figure 23B:
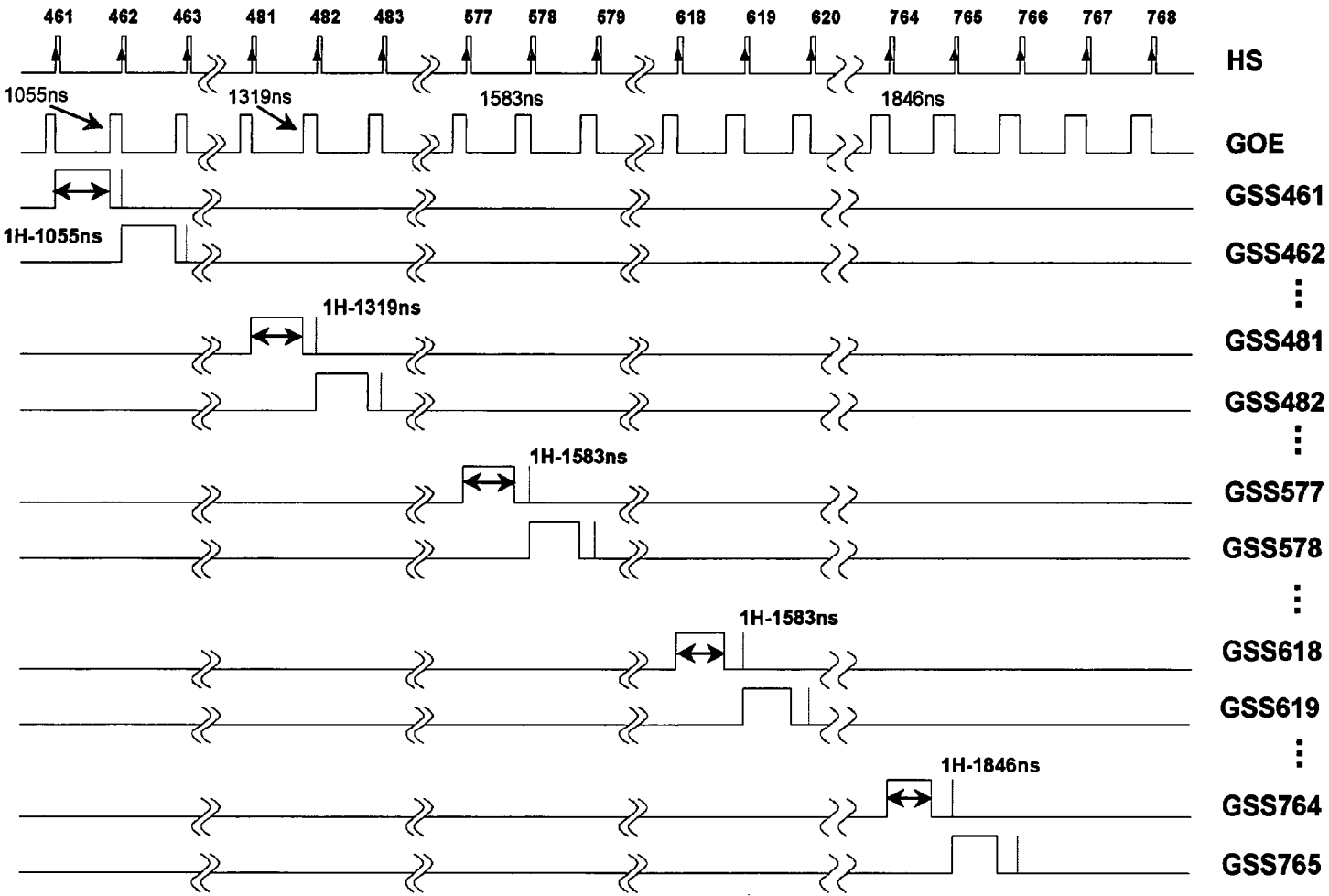
Figure 24A:
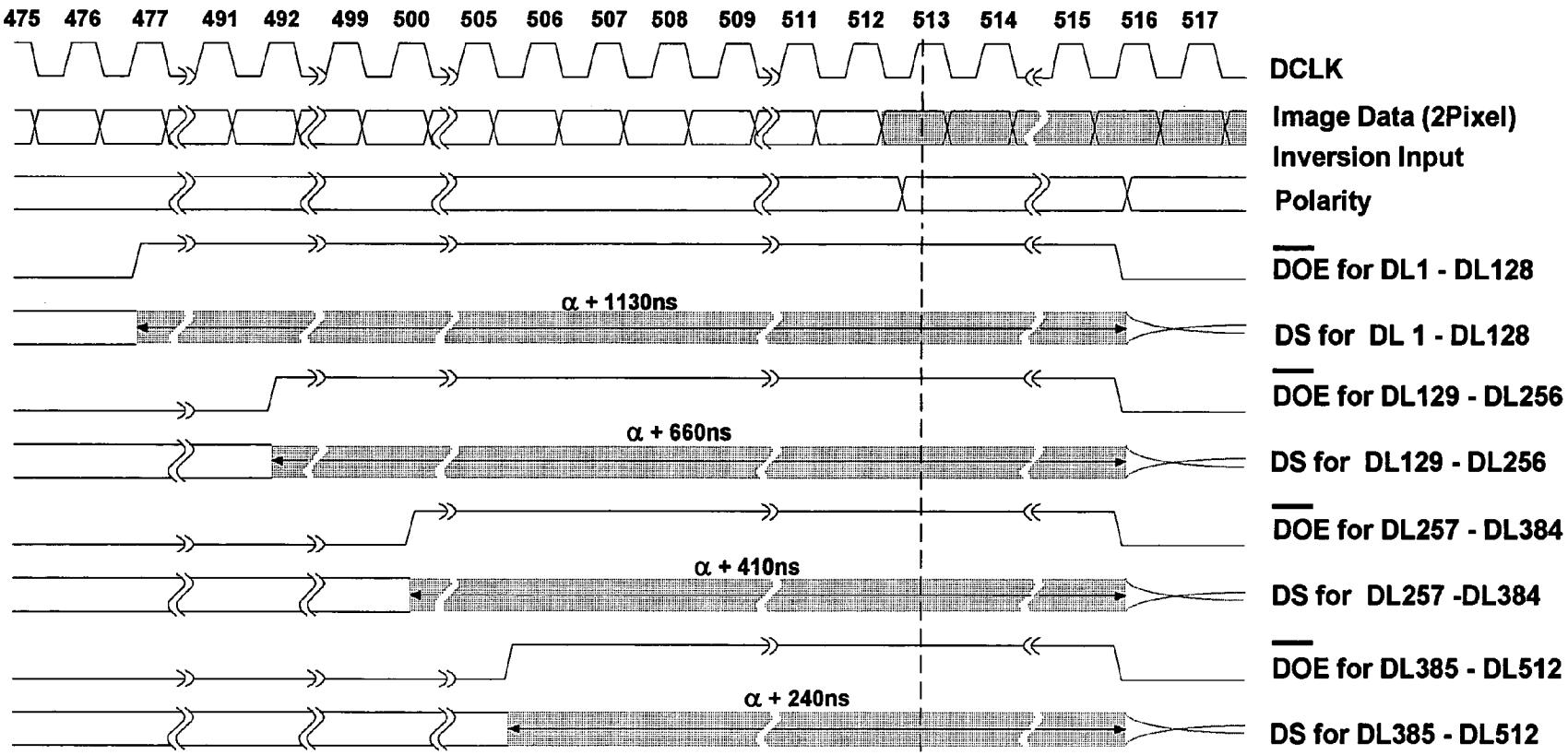
FIG. 24 is a timing chart representing a data output enable signal and a data signal applied respectively to the data driver IC chips and the signal lines shown in FIG. 22.
Figure 24B:
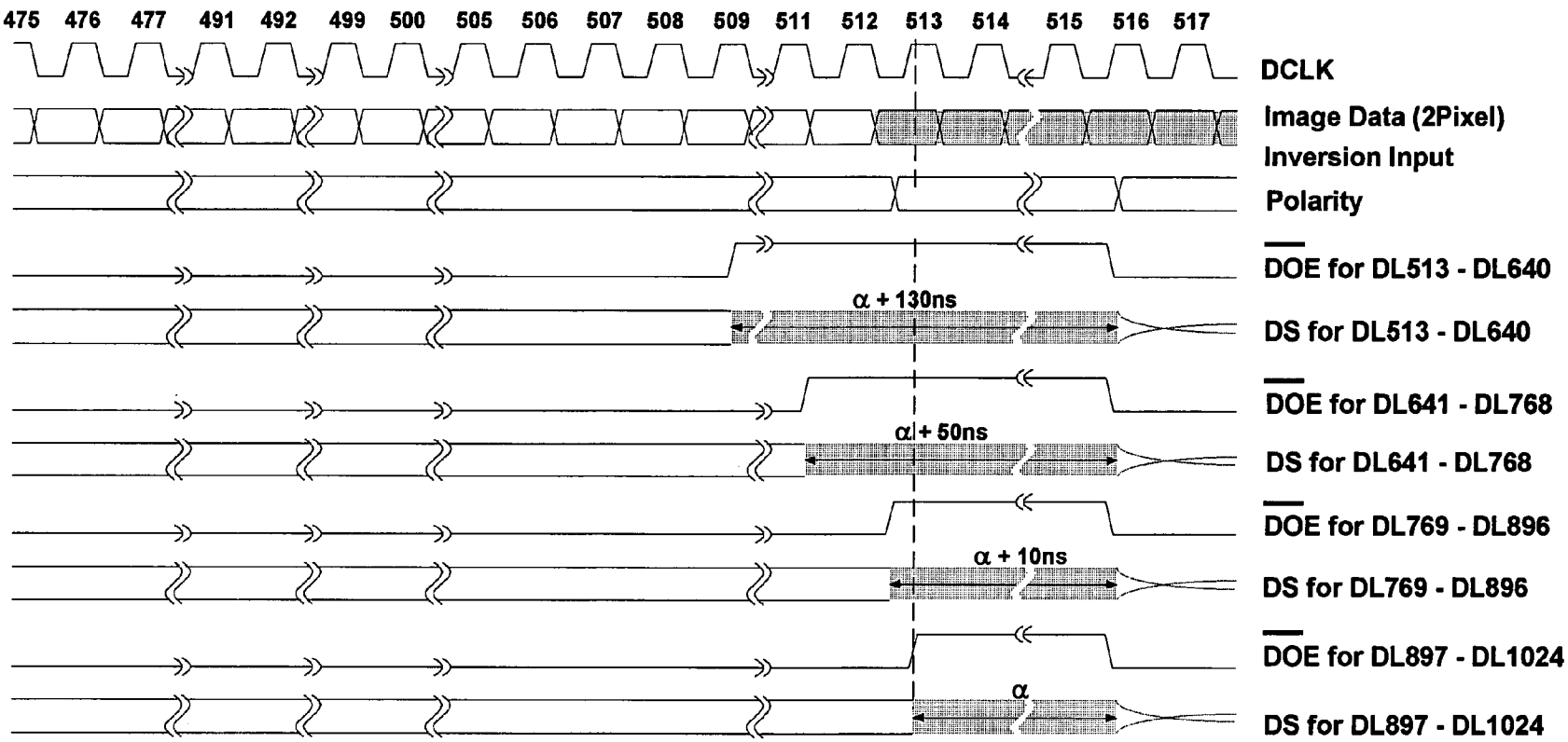
Figure 25:
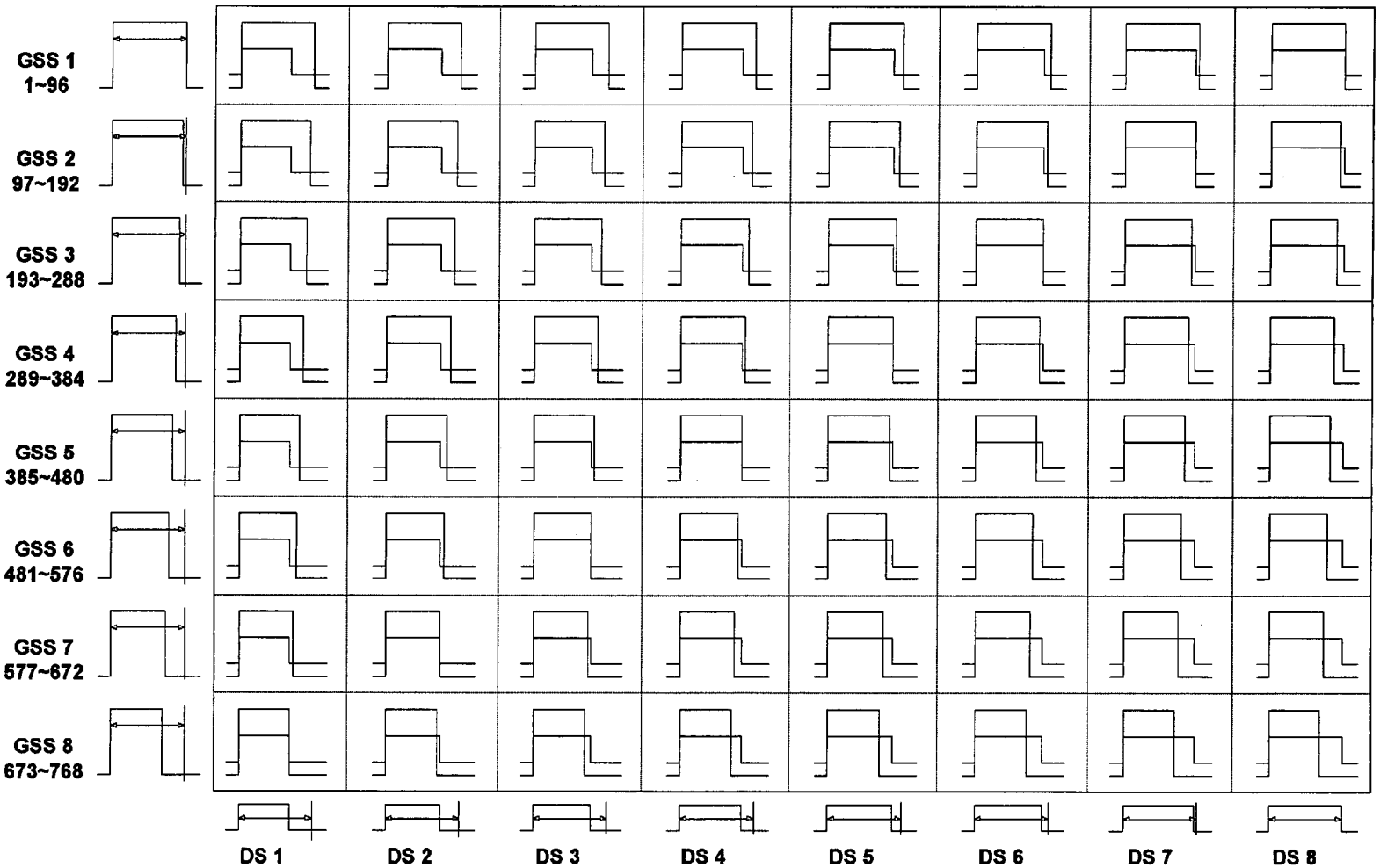
FIG. 25 is a timing chart of scanning signal and data signal applied to each the block shown in FIG. 22.
Figure 26A:
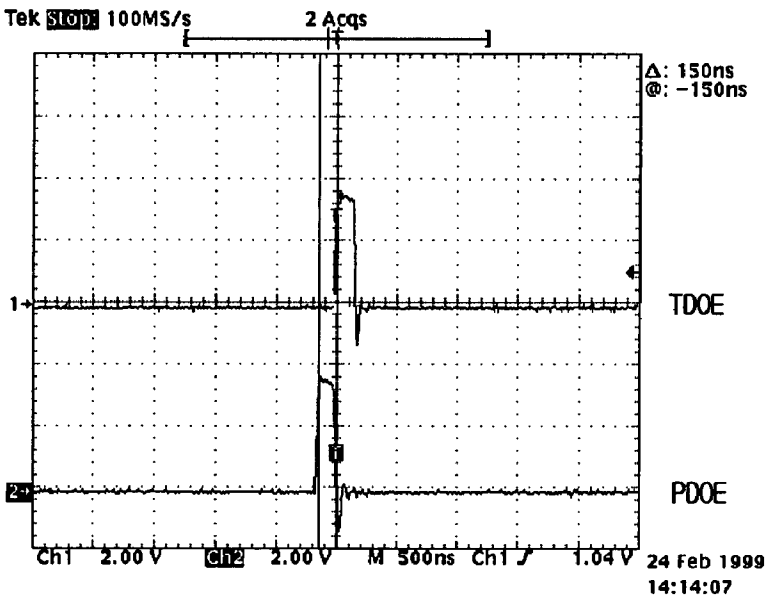
FIGS. 26A to 26D are timing charts illustrating in detail a part of the data output enable signals shown in FIG. 24.
Figure 26B:
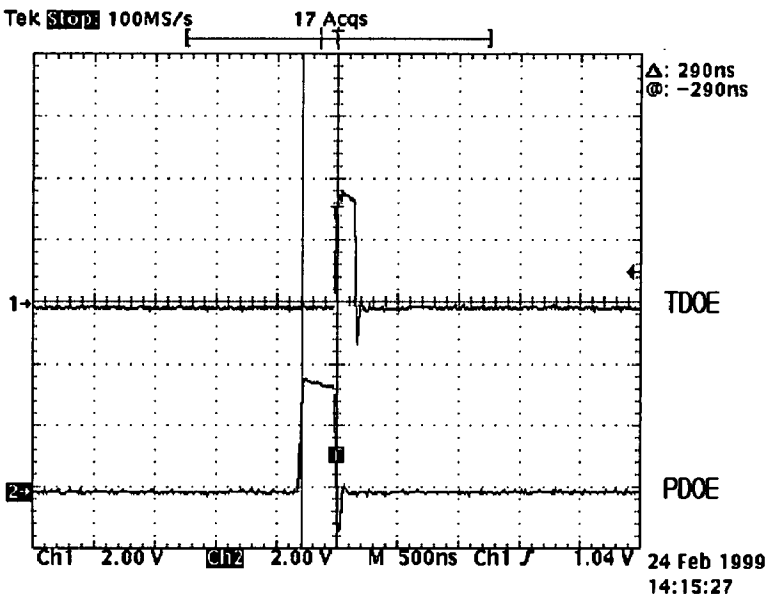
Figure 26D:
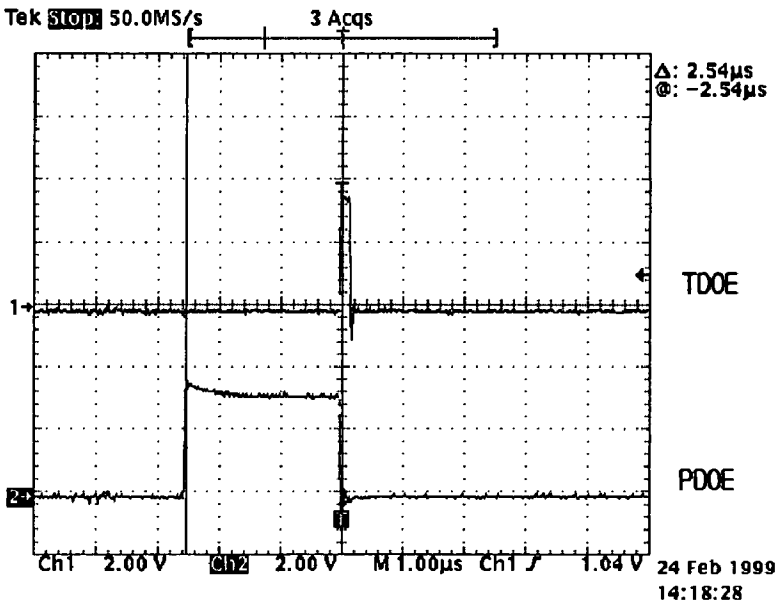
Figure 26C:
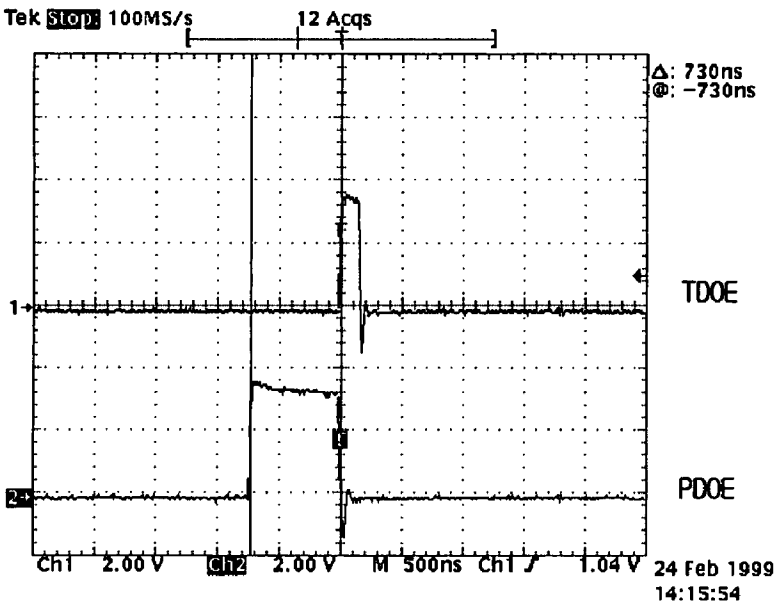
Figure 27B:
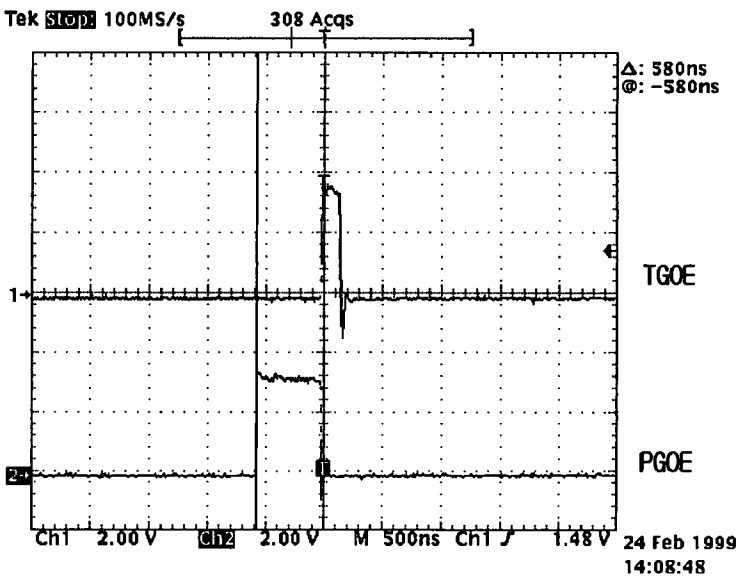
FIGS. 27A to 27D are timing charts illustrating in detail a part of the gate output enable signals shown in FIG. 23.
Figure 27A:
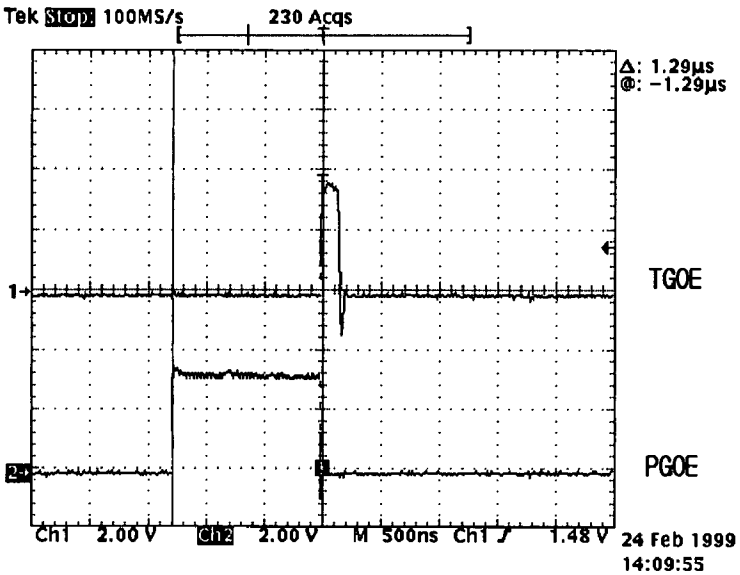
Figure 27D:
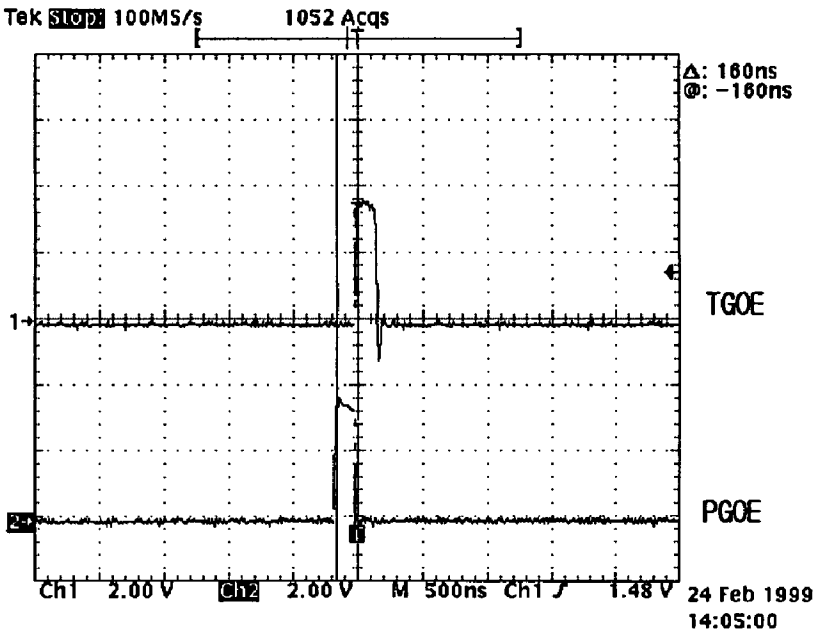
Figure 27C:
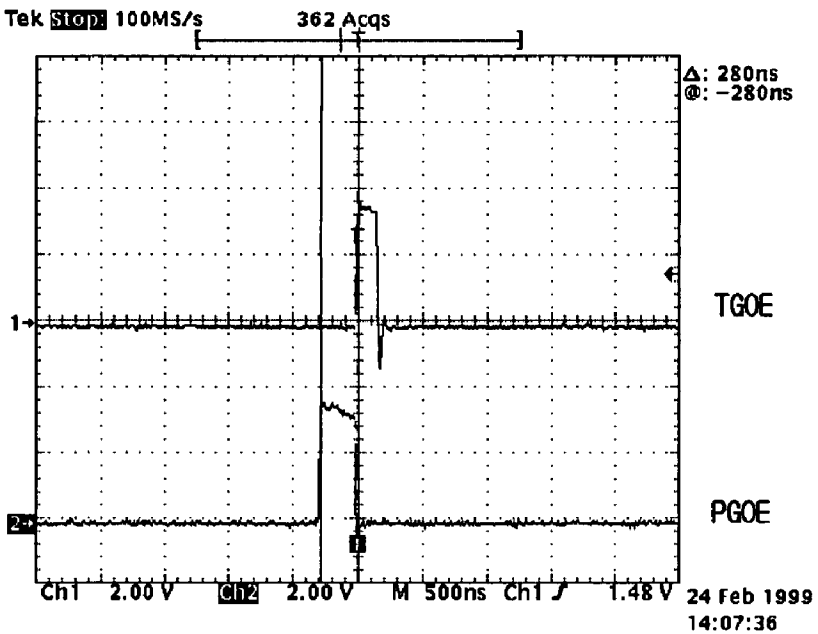

Such a uniformity of the charging time in the liquid crystal cells will be identified through a simulation for a liquid crystal panel having 1024 data lines and 768 scanning lines. In the simulation, the 1024 data lines are grouped into 8 gate sub blocks GSB1 to GSB8 and the 768 scanning lines are grouped into 8 data sub blocks DSB1 to DSB8. In other words, the liquid crystal panel having 1024×768 picture elements (i.e., pixels) is divided into M sub blocks as shown in FIG. 22. Each scanning signal GSS1 to GSS768 has a width reduced gradually in accordance with the gate sub blocks GSB1 to GSB8. In detail, the width of each the scanning signal GSS1 to GSS768 is gradually reduced from the width corresponding to the period of the horizontal synchronous signal HS in accordance with proceeding from the top gate sub block GSB1 to the bottom gate sub block GSB8, as seen in FIGS. 23A and 23B. Then, the disable period (i.e., the high logic interval) of the gate output enable signal GOE is gradually enlarged in accordance with proceeding from the top gate sub block GSB1 to the bottom gate sub block GSB8, as seen in FIGS. 23A and 23B. Similarly, the data signal DS has a different width according to the data sub blocks DSB1 to DSB8. In detail, the width of the data signal DS is gradually reduced from the width corresponding to the period of the horizontal synchronous signal HS in accordance with proceeding from the right side data sub block DSB8 to the left side data sub block DSB1, as seen in FIGS. 24A and 24B. The data signal DS to be applied to the right side data sub block DSB8 have a width nearly equal to the width corresponding to the period of the horizontal synchronous signal HS. The disable period (i.e., the high logic interval) of the data output enable signal /DOE is gradually enlarged in accordance with proceeding from the right side data sub block DSB8 to the left side data sub block DSB1, as seen in FIGS. 24A and 24B. Since the data and scanning signals DS and GSS are varied along with the sub blocks DSB1 to DSB8 and GSB1 to GSB8, the M sub blocks on the liquid crystal panel each receives a data signal DS1 to DS8 and a scanning signal GSS1 to GSS8, as shown FIG. 25.

FIGS. 26A to 26D shows in detail the data output enable signals for the first, third, fifth and eighth data sub blocks DSB1, DSB3, DSB5 and DSB8. In FIGS. 26A to 26D, a waveform TDOE represents the data output enable signals generated by the conventional panel driving method, and another waveform PDOE explains the data output enable signal produced by the panel driving method according to the present invention. The data output enable signal TDOE according to the conventional art has a constant disable period regardless to a position of the data line DL. Whereas, the disable period of the data output enable signal PDOE according to the present invention is gradually elongated in accordance with proceeding from the left side data line DL1 to the right side data line DL1024.

Figure 28B:
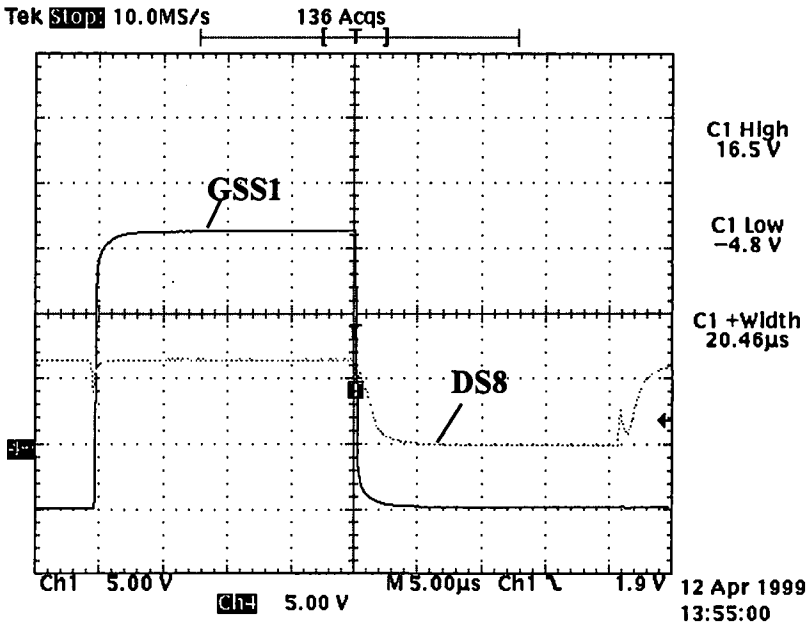
FIGS. 28A to 28D are timing charts of the scanning and data signals applied to a part of the blocks on the liquid crystal panel shown in FIG. 22.
Figure 28A:
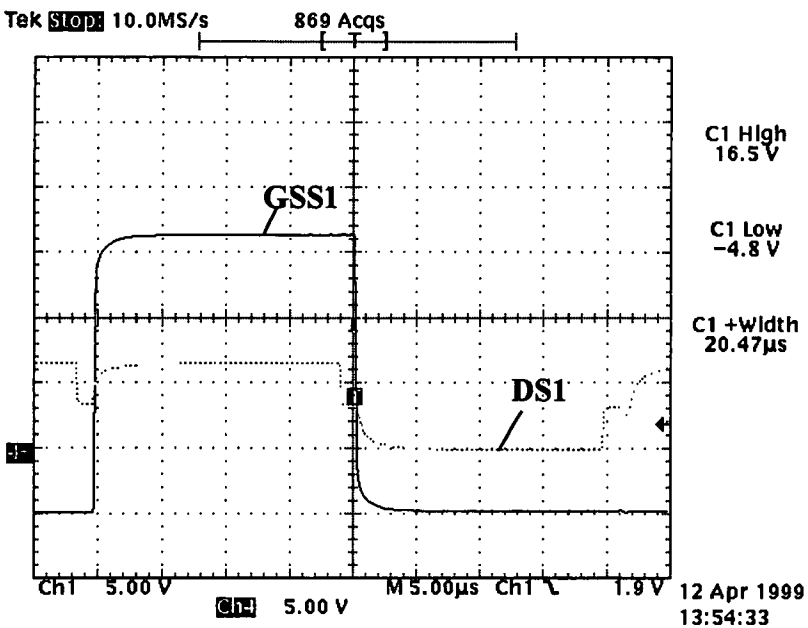
Figure 28D:
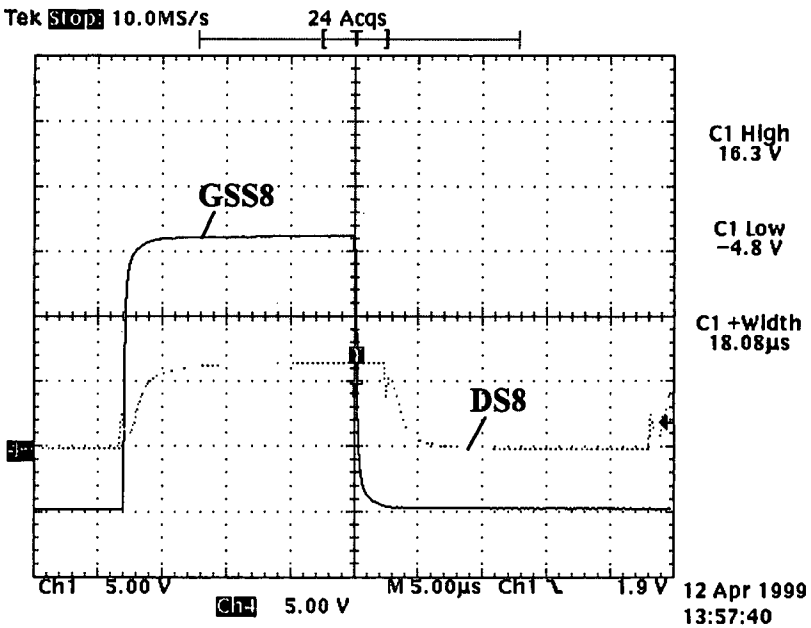
Figure 28C:
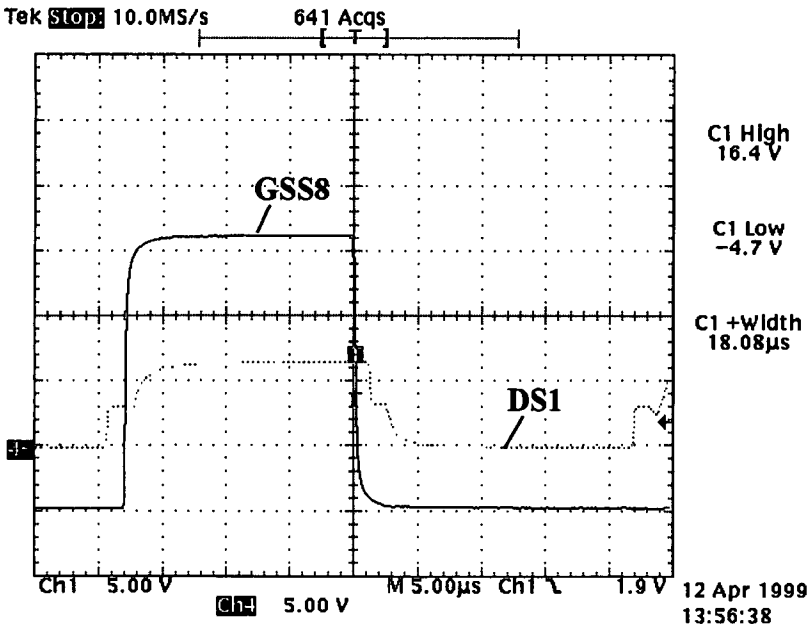

As referring FIGS. 27A to 27D, there are illustrated the disable period of each gate output enable signal for the first, third, fifth and eighth gate sub blocks GSB1, GSB3, GSB5 and GSB8 in detail. In FIGS. 27A to 27D, a waveform TGOE represents the gate output enable signals generated by the conventional panel driving method, and another waveform PGOE explains the gate output enable signal produced by the panel driving method according to the present invention. The gate output enable signal TGOE according to the conventional art has a constant disable period regardless to a position of the gate line GL. Whereas, the disable period of the gate output enable signal PGOE according to the present invention is gradually elongated along with proceeding from the top gate line GL1 to the bottom gate line DL768. The enable width of each the data and scanning signals DS1 to DS8 and GSS1 to GSS8 is varied along with a position on the data and scanning lines GL and DL so that the sub blocks located at the corners of the liquid crystal panel receive respectively the data and scanning signals DS and GSS as shown FIGS. 28A to 28D. FIG. 28A shows the waveform of each the data and scanning signals DS1 and GSS1 applied to the sub block at the left and top corner and FIG. 28B represents the waveform of each the data and scanning signals DS8 and GSS1 supplied to the sub block at the right and top corner. Also, FIG. 28C shows waveform of each the data and scanning signals DS1 and GSS8 applied to the sub block at the left and bottom corner, and FIG. 28D represents the waveform of each the data and scanning signals DS8 and GSS8 supplied to the sub block at the right and bottom corner. As FIGS. 28A to 28D, the data signal DS is synchronized with the scanning signal GSS at all of the liquid crystal cells included in the liquid crystal panel. To this end, the data signal is accurately applied to all of the liquid crystal cells included in the liquid crystal panel. Also, FIGS. 28A to 28B explain that all of the liquid crystal cells on the liquid crystal panel become uniform in the charging time. As a result, the picture displayed on the liquid crystal panel is not distorted.

The resultants of the simulation described as above are represented in shape of tables 1 and 2. In the tables 1 and 2, "CL1" to "CL4" are the respective liquid crystal cell on the corner sub blocks of the liquid crystal panel 30. Also, "Vci" and "ΔVp" represents a pixel voltage and a feed-through voltage detected at each the liquid crystal cell CL1 to CL4, respectively. Further, in the tables 1 and 2, there is included "charging period" which the liquid crystal cells CL1 to CL4 performs the charging of the data signal voltage. The pixel voltage Vci on the tables 1 and 2 represents a maximum voltage charged at each the liquid crystal cell CL1 to CL4 in the case that the data and scanning signals DS and GSS are 7V and 20V, respectively. The feed-through voltage ΔVp is the variation of the pixel voltage when the data and scanning signals DS and GSS are cut-off.

TABLE 1

| | Vci | ΔVp | Charging period |
|---|---|---|---|
| CL1 | 6.248 V | 752 mV | 7.6 μs |
| CL2 | 6.279 V | 721 mV | 8.2 μs |
| CL3 | 6.211 V | 789 mV | 10.7 μs |
| CL4 | 6.255 V | 745 mV | 10.8 μs |

TABLE 2

| | Vci | ΔVp | Charging period |
|---|---|---|---|
| CL1 | 6.256 V | 744 mV | 6.2 μs |
| CL2 | 6.268 V | 732 mV | 10.0 μs |
| CL3 | 6.237 V | 763 mV | 9.2 μs |
| CL4 | 6.258 V | 742 mV | 10.7 μs |

In order to detect the pixel voltage Vci, feed-through voltage ΔVp and charging period on the tables 1 and 2, a condition of the simulation is established as seen in table 3.

TABLE 3

| Liquid Crystal Panel | SXGA of 18.1 Inch |
|---|---|
| Horizontal Synchronous Period | 16 μs |
| Delay time on the Data line | 4.0 μs |
| Delay time on the scanning line | 5.3 μs |
| Data Signal Voltage | −5~+20 V |
| Scanning signal Voltage | +3~+7 V |
| Common Voltage | +5 V (D.C.) |

The table 1 represents the pixel voltage Vci, feed-through voltage ΔVp and charging period in the case that the liquid crystal panel is driven by means of the conventional panel driving apparatus. The conventional panel driving apparatus applies a data signal having a width of 16 μs to all of the data lines DL1 to DL1024 and a scanning signal having a width of 13.35 μs=16μ−(τg/2) to all of the scanning lines GL1 to GL768. Meanwhile, the table 2 illustrates the pixel voltage Vci, feed-through voltage ΔVp and charging period in the case that the liquid crystal panel is driven by means of the conventional panel driving apparatus according to the present invention. In the panel driving apparatus according to the present invention, a data signal having a width gradually reduced from the width of 14 μS=16 μs−(τg/2) is applied to all of the data lines DL1 to DL1024 and a scanning signal having a width gradually reduced from the width of 13.35 is supplied to all of the scanning lines GL1 to GL768. As referring the tables 1 and 2, the feed-through voltage ΔVp caused by the conventional panel driving apparatus has the deviation of 68 mV, while the feed-through voltage ΔVp generated in the panel driving apparatus of FIG. 17 has a reduced deviation in 31 mV. Consequently, the deviation of the feed-through voltage ΔVp in the panel driving apparatus according to the present invention decreases below half of that in the conventional panel driving apparatus.

Figure 29:
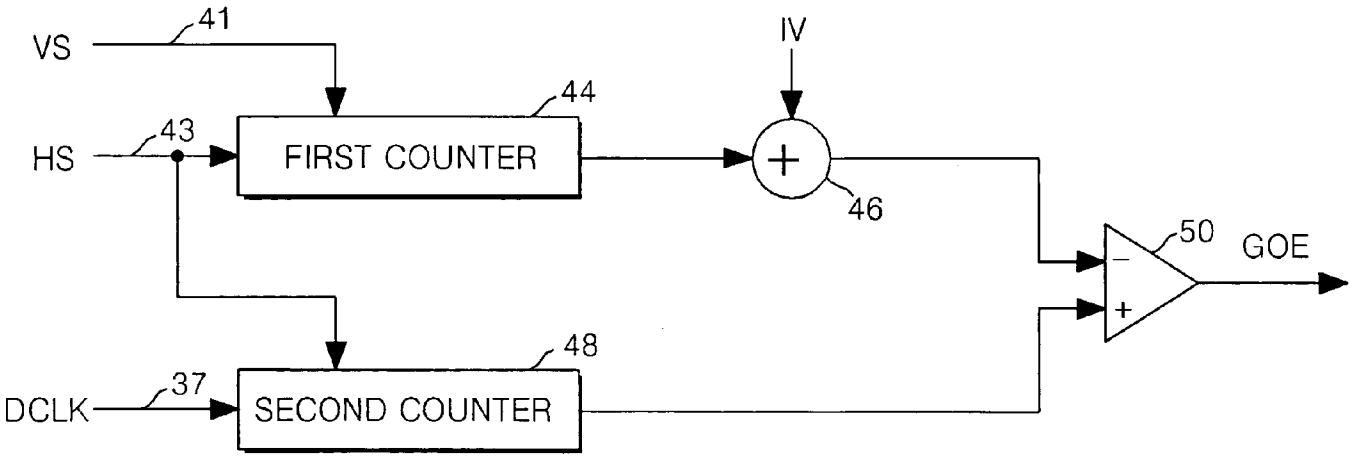
FIG. 29 is a detailed block diagram of the second controller shown in FIG. 17.

FIG. 29 is a detailed block diagram of the second controller 42 shown in FIG. 17. In FIG. 29, the second controller 42 includes first counter 44 receiving the vertical synchronous signal VS from the first synchronous line 41 and the horizontal synchronous signal HS from the second synchronous line 43, and second counter 46 inputting the data clock DCLK from the clock line 37. The first counter 44 resets an output value in "0" at the blanking period of the vertical synchronous signal VS and counts the horizontal synchronous signal HS during the scanning period of the vertical synchronous signal VS. The value counted by the first counter 44 is added to an initial value by means of an adder 48. The adder 48 then generates a reference value increasing by "1" from the initial value IV every period of the horizontal synchronous signal HS. The reference value is applied to a comparator 50. The second counter 46 resets an output value in "0" at the blanking period of the horizontal synchronous signal HS and counts the data clock DCLK during the scanning period of the horizontal synchronous signal HS. The value counted by the second counter 46 is compared with the reference value in the comparator 50 in order to generate the gate enable signal GOE. The gate enable signal GOE has a high logic value when the reference value is larger than the counted value from the second counter 46. If the reference value is smallest than the value counted by the second counter 46, the gate enable signal GOE has a low logic value. In the comparator 50, there is generated the gate enable signal GOE having the low logic interval which is gradually increased by the period of the data clock DCLK every period of the horizontal synchronous signal HS during the scanning period of the vertical synchronous signal VS.

As described above, according to the present invention, data signals applied to the signal wiring in accordance with a delay characteristic in the scanning wiring of the liquid crystal panel are delayed, thereby preventing signal voltages charged in the liquid crystal cells from being distorted. Alternatively, according to the present invention, a time interval at which data signals are applied to the signal wiring in accordance with a delay characteristic in the scanning wiring of the liquid crystal panel is lengthened, thereby preventing signal voltages charged in the liquid crystal cells from being distorted. As a result, the present invention is capable of displaying a non-distorted image on the liquid crystal panel as well as uniforming a light transmissivity in the liquid crystal panel.

Although the present invention has been explained by the embodiments shown in the drawing hereinbefore, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a matrix type liquid crystal panel provided with a plurality of thin film transistors coupled to scanning wires and signal wires, and a plurality of liquid crystal cells, at intersecting points of the scanning wires and the signal wires, the method comprising steps of:

applying a scanning signal to the scanning wire; and supplying data signals having a width enlarged in accordance with an increased distance from a source of the scanning signal to the signal wires, wherein an accurate data signal is applied to each of the plurality of liquid crystal cells such that a picture displayed on the liquid crystal panel is not distorted.

2. A method of driving a matrix type liquid crystal panel provided with a plurality of thin film transistors coupled to scanning wires and signal wires, and a plurality of liquid crystal cells, at intersecting points of the scanning wires and the signal wires, the method comprising steps of:

applying a scanning signal pulse to the scanning wire;

supplying data signals to the signal wires; and allowing the data signals to be supplied to the signal wires to have a width enlarged in accordance with an increased distance from a source of the scanning wire, wherein an accurate data signal is applied to each of the plurality of liquid crystal cells such that a picture displayed on the liquid crystal panel is not distorted.

3. A method of driving a matrix type liquid crystal panel provided with a plurality of thin film transistors coupled to scanning wires and signal wires, and a plurality of liquid crystal cells, at intersecting points of the scanning wires and the signal wires, the method comprising steps of:

applying data signals to the signal wires; and supplying a scanning signal having a width reduced in accordance with an increased distance from a source of the signal wire to the scanning wire.

4. A method of driving a matrix type liquid crystal panel provided with a plurality of thin film transistors coupled to scanning wires and signal wires, and a plurality of liquid crystal cells, at intersecting points of the scanning wires and the signal wires, the method comprising steps of:

applying a scanning signal having a width varied in accordance with a position of the signal wire relative to the scanning wire; and supplying data signals having a width enlarged in accordance with a distance from a source of the scanning wire to the signal wires.

5. An apparatus for driving a matrix type liquid crystal panel provided with a plurality of thin film transistors coupled to scanning wires and signal wires, and a plurality of liquid crystal cells, at intersecting points of the scanning wires and the signal wires, the apparatus comprising:

scanning side driving means for applying a scanning signal to the scanning wire;

signal side driving means for supplying data signals to the signal wires; and width control means for allowing the scanning signal to have a width reduced in accordance with an increased distance from a source of the signal wire.

6. The apparatus as set forth in claim 5, wherein the signal side driving means includes a plurality of signal wire driving cells for dividing the signal wires by a certain area and supplying the data signals to the divided areas.

7. The apparatus as set forth in claim 5, wherein the width control means applies an output enable signal to the scanning side driving means, the output enable signal having a width of a disable period enlarged in accordance with proceeding from the start point to the end point of the signal wire.

8. An apparatus for driving a matrix type liquid crystal panel provided with a plurality of thin film transistors coupled to scanning wires and signal wires, and a plurality of liquid crystal cells, at intersecting points of the scanning wires and the signal wires, the apparatus comprising:

scanning side driving means for applying a scanning signal to the scanning wire; and signal side driving means for supplying data signals having a width enlarged in accordance with an increased distance from a source on the scanning wire to the signal wires, wherein an accurate data signal is applied to each of the plurality of liquid crystal cells such that a picture displayed on the liquid crystal panel is not distorted.

9. The apparatus as set forth in claim 8, wherein the signal side driving means comprises:

a plurality of signal wire driving cells for dividing the signal wires by a certain area and supplying data signals to the divided areas; and control means for driving the signal wire driving cells in such a manner that the width of the data signal to be transmitted from each signal wire driving cell to each of the signal wires is gradually enlarged.

10. The driving apparatus as set forth in claim 9, wherein the control means includes a width expander for expanding the width of an output enable signal controlling output start points of each of the signal wire driving cell by a predetermined interval.

11. An apparatus for driving a matrix type liquid crystal panel provided with a plurality of thin film transistors coupled to scanning wires and signal wires, and a plurality of liquid crystal cells, at intersecting points of the scanning wires and the signal wires, the apparatus comprising:

scanning side driving means for applying a scanning signal to the scanning wire;

signal side driving means for supplying data signals to the signal wires; and width control means for making the data signals to be supplied to the signal wires have an width enlarged in accordance with an increased distance from a source on the scanning wire, wherein an accurate data signal is applied to each of the plurality of liquid crystal cells such that a picture displayed on the liquid crystal panel is not distorted.

12. The apparatus as set forth in claim 11, wherein said signal side driving means includes a plurality of signal wire driving cells for dividing the signal wires by a certain area and supplying the data signals to the divided areas.

13. The apparatus as set forth in claim 11, wherein the width control means includes a width expander for enlarging a width of an output enable signal controlling an output interval of the data signal at each of the signal view driving cells by a predetermined interval.

14. A driving apparatus for a matrix type liquid crystal panel provided with a plurality of thin film transistors coupled to scanning wires and signal wires, and a plurality of liquid crystal cells, at intersecting points of the scanning wires and the signal wires, the apparatus comprising:

scanning side driving means for applying a scanning signal having a width varied in accordance with a distance from a source of the signal wire to the scanning wire; and signal side driving means for supplying a data signal having a width enlarged in accordance with a distance from a source of the scanning wire to the signal wire.

15. A driving system for a liquid crystal display device having a plurality of scanning lines, a plurality of data lines generally orthogonal to the scanning lines, a plurality of thin film transistors coupled to scanning wires and signal wires, and a plurality of liquid crystal cells formed at the intersections of data lines and scanning lines, the driving system comprising:

a plurality of scanning driver integrated circuits connected to the scanning lines for applying scanning signals thereto;

a plurality of data driver integrated circuits connected to the data lines for applying data signals thereto; and a width controller for varying time periods during which the data signals are applied by the data driver integrated circuits to the data lines in accordance with the data lines' respective positions relative to a scanning line source.

16. The driving system of claim 15, wherein the width controller supplies output enable signals to the data driver integrated circuits to control the time periods during which the data signals are applied by the data driver integrated circuits to the data lines.

17. A driving system for a liquid crystal display device having a plurality of scanning lines, a plurality of data lines generally orthogonal to the scanning lines, a plurality of thin film transistors coupled to scanning wires and signal wires, and a plurality of liquid crystal cells formed at the intersections of data lines and scanning lines, the driving system comprising:

a plurality of scanning driver integrated circuits connected to the scanning lines for applying scanning signals thereto;

a plurality of data driver integrated circuits connected to the data lines for applying data signals thereto; and a controller for varying time periods during which the scanning signals are applied by the scanning driver integrated circuits to the scanning lines in accordance with the scanning lines' respective positions relative to a data line source.

18. The driving system of claim 17, wherein the controller supplies output enable signals to the scanning driver integrated circuits to control the widths of the time periods during which the scanning signals are applied by the scanning driver integrated circuits to the scanning lines.

19. A method of driving a liquid crystal display (LCD) device having a plurality of scanning lines, a plurality of data lines generally orthogonal to the scanning lines, a plurality of thin film transistors coupled to scanning wires and signal wires, and a plurality of liquid crystal cells formed at the intersections of data lines and scanning lines, the method comprising:

applying a scanning line signal from a scanning driver integrated circuit (IC) to one of the scanning lines of the LCD connected at one end to the scanning driver IC; and applying data line signals to each of the data lines, a first width of a first one of the data line signals applied to a first one of the data lines located a first distance from the scanning driver IC being greater than a second width of a second one of the data line signals applied to a second one of the data lines located a second distance from the scanning driver IC, wherein the first distance is greater than the second distance, wherein an accurate data signal is applied to each of the plurality of liquid crystal cells such that a picture displayed on the liquid crystal panel is not distorted.

20. The method of claim 19, wherein applying the data signals to each of the data lines, comprises:

supplying a data signal to a plurality of data driver integrated circuits connected to the data lines; and supplying output enable signals to the data driver integrated circuits, wherein a width of a disable period of a first one of the output enable signals applied to a first one of the data driver integrated circuits connected to the first of the data lines is less than a width of a disable period of a second one of the output enable signals applied to a second one of the data driver integrated circuits connected to the second one of the data lines.

21. A method of driving a liquid crystal display (LCD) device having a plurality of scanning lines, a plurality of data lines generally orthogonal to the scanning lines, a plurality of thin film transistors coupled to scanning wires and signal wires, and a plurality of liquid crystal cells formed at the intersections of data lines and scanning lines, the method comprising:

applying data line signals from a plurality of data driver integrated circuits (ICs) to the data lines of the LCD, each data line being connected at one end to one of the data driver ICs; and applying scanning line signals to each of the scanning lines, a first width of a first one of the scanning line signals applied to a first one of the scanning lines located a first distance from the data driver ICs being different from a second width of a second one of the scanning line signals applied to a second one of the scanning lines located a second distance from the data driver ICs, wherein the first distance is greater than the second distance.

22. The method of claim 21, wherein applying the scanning line signals to each of the scanning lines comprises supplying output enable signals to the scanning driver integrated circuits, wherein a width of a disable period of a first one of the output enable signals applied to a first one of the scanning driver integrated circuits connected to the first of the scanning lines is greater than a width of a disable period of a second one of the output enable signals applied to a second one of the scanning driver integrated circuits connected to the second one of the scanning lines.

23. A method for driving a liquid crystal display device having a plurality of scanning lines, a plurality of data lines, a plurality of thin film transistors coupled to scanning wires and signal wires, a plurality of data signal sources and a plurality of scanning signal sources comprising:

controlling scanning signals supplied to the scanning lines; and controlling data signals supplied to the data lines;

wherein the data signals have widths enlarged depending on an increased distance of the data lines from the scanning signal sources, wherein an accurate data signal is applied to each of the plurality of liquid crystal cells such that a picture displayed on the liquid crystal panel is not distorted.

24. A method for driving a liquid crystal display device having a plurality of scanning lines, a plurality of data lines, a plurality of thin film transistors coupled to scanning wires and signal wires, a plurality of data signal sources and a plurality of scanning signal sources comprising:

controlling a scanning signal supplied to the scanning lines; and controlling a data signal supplied to the data lines;

wherein the scanning signal has a reduced width in proportion to an increased distance of the scanning lines from the scanning signal sources.

25. A method for driving a liquid crystal display device having a plurality of scanning lines, a plurality of data lines, a plurality of thin film transistors coupled to scanning wires and signal wires, a plurality of data signal sources and a plurality of scanning signal sources comprising:

controlling a scanning signal supplied to the scanning lines; and controlling a data signal supplied to the data lines;

wherein the scanning signal has a reduced width in proportion to an increased distance of the scanning lines from the data signal sources; and wherein a width expander is utilized for controlling the width of the scanning signal voltage.

26. A driving system for driving a liquid crystal display device having a plurality of scanning lines, a plurality of data lines, a plurality of thin film transistors coupled to scanning wires and signal wires, a plurality of data signal sources and a plurality of scanning signal sources comprising:

a plurality of data drivers;

a plurality of gate drivers; and a plurality of width expanders for controlling widths of data signals provided to the data lines in accordance with a distance from the data lines to the scanning signal sources;

wherein a scanning signal has a varying width depending on the distance of the scanning lines from the data signal sources.

27. A driving system driving a liquid crystal display device having a plurality of scanning lines, a plurality of data lines, a plurality of thin film transistors coupled to scanning wires and signal wires, a plurality of data signal sources and a plurality of scanning signal sources comprising:

a plurality of data drivers;

a plurality of gate drivers; and a plurality of width expanders for controlling widths of a scanning signal provided to the scanning lines in accordance with a position of the scanning lines relative to the data signal sources;

wherein a plurality of data signals have varying widths depending on the distance of the data lines from the scanning signal sources.

* * * * *